US007870667B2

(12) United States Patent
Takada

(10) Patent No.: US 7,870,667 B2
(45) Date of Patent: Jan. 18, 2011

(54) TERMINAL CRIMPING APPARATUS AND METHOD OF CRIMPING A TERMINAL

(75) Inventor: Kazuhiko Takada, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 248 days.

(21) Appl. No.: 11/712,421

(22) Filed: Mar. 1, 2007

(65) Prior Publication Data

US 2007/0234558 A1 Oct. 11, 2007

(30) Foreign Application Priority Data

Apr. 7, 2006 (JP) ..... 2006-106027

(51) Int. Cl.
*H01R 43/04* (2006.01)

(52) U.S. Cl. ..... 29/861; 29/862; 29/753; 29/747; 174/72 A; 174/86; 174/71 C; 174/93; 72/21.4; 72/413; 72/705

(58) Field of Classification Search ..... 29/715, 29/745, 747–749, 751–753, 828, 837, 838, 29/857, 861, 854, 862, 882, 761; 174/72 A, 174/74 R, 86, 71 C, 93, 84 C, 650; 72/21.4, 72/413, 428, 705, 712

See application file for complete search history.

(56) References Cited

U.S. PATENT DOCUMENTS 3,867,754 A * 2/1975 Koch et al. ..... 29/56.6
3,969,806 A * 7/1976 McCaughey ..... 29/515
4,114,253 A * 9/1978 Loomis et al. ..... 29/566.2
5,058,260 A * 10/1991 Gloe et al. ..... 29/564.4
5,353,625 A * 10/1994 Hoshino et al. ..... 72/416
5,495,662 A * 3/1996 Nitta et al. ..... 29/753
5,727,409 A * 3/1998 Inoue et al. ..... 72/21.1
6,742,251 B1 * 6/2004 Fukase ..... 29/863

FOREIGN PATENT DOCUMENTS

JP 3456422 8/2003

* cited by examiner

*Primary Examiner*—Derris H Banks
*Assistant Examiner*—Jeffrey Carley
(74) *Attorney, Agent, or Firm*—Kratz, Quintos & Hanson, LLP

(57) ABSTRACT

To provide a reliable terminal crimping apparatus and a terminal crimping method, which crimps an electric wire to a terminal having crimping pieces, ends of which curve in a direction of approaching each other, the terminal crimping apparatus includes a first die for placing the terminal on a surface thereof, a second die arranged correspondingly to the first die and freely approaching and parting the first die to crimp the crimp pieces by approaching the first die, and a third die arranged correspondingly to the first die and freely approaching and leaving from the first die to approach the first die before the second die crimps the crimping piece so as to push the electric wire toward the bottom plate and insert the electric wire between the pair of crimp pieces.

15 Claims, 14 Drawing Sheets

TERMINAL CRIMPING APPARATUS AND METHOD OF CRIMPING A TERMINAL

The priority application Number Japan Patent Application 2006-106027 upon which this patent application is based is hereby incorporated by reference.

FIELD OF INVENTION

The present invention relates to a terminal crimping apparatus and a method for crimping a terminal, which crimps an electric wire to a terminal having crimping pieces, the ends of which are curved in the direction of approaching each other.

RELATED ARTS

When constructing a wiring harness, in which a terminal is electrically connected to an electric wire, i.e. by crimping the crimping piece of the terminal to the electric wire, various crimping apparatus is used (as an example, refer Patent Document 1). The terminal crimping apparatus has an anvil, a crimper, and a driving unit. The anvil and the crimper are arranged movably in the direction of approaching and parting each other to crimp an end of the electric wire to the crimping piece of the terminal by inserting the end of the electric wire in between the crimping pieces. The driving unit moves the anvil and the crimper in the direction of approaching and parting each other.

In the mentioned terminal crimping apparatus referred in Patent Document 1, a braid of a shielded wire in which the inner terminal is previously crimped to the core is crimped to an outer terminal, which is electrically isolated from the inner terminal while containing the same. The outer terminal has a bottom plate for positioning the braid of the shielded wire on the surface of the bottom plate and a pair of crimping pieces extending from outer edges of the bottom plate. By inserting the braid of the wire between the crimping pieces and then, bending the crimping pieces towards the bottom plate the outer terminal is electrically connected with the braid. The crimping piece of the outer terminal is more tightly contacted with the braid of a shielded wire by crimping, since each end of the crimping pieces parted from the bottom plate are previously curved in the direction of approaching each other.

In the mentioned terminal crimping apparatus referred in Patent Document 1, after the inner terminal is inserted into the outer terminal, the braid of a shielded terminal connected with the inner terminal is inserted in between the crimping pieces and the inner terminal is inserted in between the outer terminal while the crimping pieces are bent by moving the anvil towards the crimper close to each other. The terminal crimping apparatus shown in Patent Document 1 assembles the terminal of a coaxial cable by assembling the outer terminal and the inner terminal and connecting the shielded wire to the outer terminal.

Patent Document 1 is JP 3456422.

SUMMARY OF THE INVENTION

In a terminal crimping apparatus by prior art as referred in Patent Document 1, since the crimping piece has a curved end there was a possibility of a problem that the braid wire is interfered with the end of the crimping piece when inserting the braid wire of the shield wire between the crimping pieces. When the braid is interfered with the end of the crimping piece, the crimping piece shall be crimped while the braid is not thoroughly inserted in between the crimping pieces. Thereby, was a possibility that the braid and the crimping pieces, that is, the outer terminal are not sufficiently connected with each other. Therefore, by using the crimping apparatus mentioned in Patent Document 1, there was a possibility that the braid (i.e. the shielded wire) is not securely crimped to the terminal.

An object of the present invention is to provide a reliable terminal crimping apparatus and a terminal crimping method, which crimps an electric wire to a terminal having crimping pieces, ends of which curve in a direction of approaching each other.

In order to attain the mentioned object, a terminal crimping apparatus according to the present invention, for connecting an electric wire and a terminal, in which a pair of crimping pieces extending vertically from a bottom plate is formed at each end farther from the bottom plate with a curved portion curved to approach each other to crimp the terminal by bending the crimp pieces so as to make the ends thereof close to the bottom plate, includes a first die for placing the terminal on a surface thereof, a second die arranged correspondingly to the first die and freely approaching and parting the first die to crimp the crimp pieces by approaching the first die, and a third die arranged correspondingly to the first die and freely approaching and leaving from the first die to approach the first die before the second die crimps the crimping piece so as to push the electric wire toward the bottom plate and insert the electric wire between the pair of crimp pieces.

A terminal crimping apparatus mentioned above is further characterized in that the third die is arranged slidably in a direction of which the first die and the second die approach and part with each other and is urged towards the first die by an urging device, further projecting towards the first die than the second die when the third die is separated from the first part.

A terminal crimping apparatus mentioned above further including a driving unit for moving the third and the second dies to approach and part together from the first die, and the driving unit is a servomotor.

In a terminal crimping apparatus mentioned above, the first die and the second die are arranged slidably in the direction of approaching and parting each other. A positioning jig is provided to urge towards the first die by an urging device and position the terminal by approaching towards the first die and clamping the terminal between the first die and itself before the third die inserts the electric wire in between the crimping pieces.

In a terminal crimping apparatus mentioned above includes a detecting device in which detects whether or not the third parts has inserted the electric wire in between the pair of crimping pieces.

A terminal crimping apparatus mentioned above includes a pressure-contact member, which connects the electric wire to a pressure-contact portion provided at the terminal by pressing the electric wire towards the pressure-contact portion.

In a terminal crimping method according to the present invention, a pair of a crimping pieces extends vertically from a bottom plate of a terminal which is curved in a direction of approaching each other at an end thereof farther from the bottom plate is bent towards the bottom plate of the terminal to crimp the electric wire to the crimping pieces. The method includes the steps of positioning the terminal on a surface of a first die, inserting the electric wire in between the pair of crimping pieces, moving the first die and a second die towards each other, and crimping the electric wire with the crimping pieces.

In the terminal crimping apparatus according to the present invention, the electric wire is securely inserted in between the curved crimping pieces by having a third die which inserts the electric wire in between the pair of crimping pieces-by pressing the electric wire towards the bottom plate before the second die crimps the crimping pieces.

Further, since the second die presses the electric wire towards the bottom plate, relative displacement of the electric wire and the terminal in the lengthwise direction of the electric wire is prevented.

In a terminal crimping apparatus according to the present invention, since the third die is slidably attached to the second die, both the third die and the second die can slide in the direction of approaching and parting the first die with only one driving means. Further, since the third die projects more towards the first die than the second die by an urging device, when both the third die and the second die are moved in the direction of approaching and parting the first die with only one driving device, the third die is still capable of inserting the electric wire in between the pair of crimping pieces before the second die crimps the crimping pieces. Still further since the third die is arranged slidably with the second die and urged by an urging device while the second die crimps the crimping pieces, the third die slides respectively with the second die by the pressing force of the first die repelling the urging force of the urging means.

In a terminal crimping apparatus according to the present invention, because the servomotor is used as the driving device for moving the second die and the third die, the second die and the third dies are enabled to moved towards the first die in a sequential steps, in which the third die inserts the electric wire in between the crimping pieces, and the second die crimps the crimping pieces.

In a terminal crimping apparatus according to the present invention, because the terminal crimping apparatus is provided with a positioning jig for positioning the terminal, before the third part inserts the electric wire in between the crimping pieces, the electric wire is securely inserted in between the pair of crimping pieces by the third die.

In a terminal crimping apparatus according to the present invention, because the terminal crimping apparatus is provided with a detecting means for detecting whether or not the third part has inserted the electric wire in between the crimping pieces, crimping work could be temporary stopped to prevent any defection, such as an insufficient insertion so that the defection rate of crimping the electric wire to the crimping terminal can be reduced.

In a terminal crimping apparatus according to the present invention, because the second die is capable of pressure-contacting the electric wire to the pressure-contact portion of the terminal, it is possible to pressure-contact the electric wire to the pressure-contact portion while crimping the electric wire to the crimping pieces.

In a terminal crimping method according to the present invention, because the electric wire is inserted in between the pair of crimping pieces before the crimping work, the electric wire is securely positioned in between the curved crimping pieces.

EFFECTS OF THE INVENTION

As mentioned above, in the present invention the electric wire can be connected securely to a terminal by crimping, since the electric wire is securely inserted in between the curved crimping pieces.

Further, because the electric wire and the terminal are prevented from displacement in relation with each other in the lengthwise direction of the electric wire, the electric wire and the terminal are securely crimped while the electric wire and the terminal maintains a relative position thereof. Therefore, the electric wire with the terminal can be produced in a preferred quality.

In the present invention, because both the third die and the second die is moved in the direction of approaching and parting the first die with only one driving unit, the number of components is reduced and the production cost of the terminal crimping apparatus will be reduced.

Further when the second die and the third die is moved in the direction of approaching and parting the first die with one driving unit, the third part inserts the electric wire in between the crimping pieces before the second die crimps the crimping pieces and the electric wire is securely crimped with the curved crimping pieces of a terminal.

Still further, while the second die crimps the crimping pieces, since the third die slides respectively with the second die with the pressing force of the first die repelling the urging force of the urging means, obstruction of the crimping work by the third die, while the second die crimps the crimping pieces is prevented. Therefore, the electric wire is securely attached to the terminal.

In the present invention, because the second die and the third die could be moved towards the first die stepwisely by divided steps, in which the third die inserts the electric wire in between the crimping pieces, and the second die crimps the crimping pieces, the completion of each step could be monitored, whereby the defection rate is reduced and prevents deterioration in the quality.

In the present invention, because the third die is capable of inserting the electric wire in between the pair of crimping pieces, the electric wire is securely crimped to the terminal.

In the present invention, because the terminal crimping apparatus is provided with the detecting means for detecting weather or not the third part has inserted the electric wire in between the crimping piece, the defection while crimping the electric wire to the crimping terminal is reduced.

In the present invention, because the wire is pressure contacted to the pressure contact portion during the crimping work of the electric wire to the crimping pieces, and the braid conductor to the crimping piece, and while pressure-contacting the core to the pressure contact portion, it is possible to crimp a shielded wire (as the electric wire) to a terminal for a shielded wire in one step. Therefore, the crimping work (the shielded wire to the terminal for a shielded wire) is done in one process and prevents an increase in the work step.

In the present invention, because the electric wire is securely positioned in between the curved crimping pieces, the electric wire is securely crimped to the terminal.

PREFERABLE EMBODIMENT

An example of preferred embodiment according to the present invention will now be shown, by way of example only, with reference to FIGS. 1-14.

A terminal crimping apparatus 1 crimps an electric plug 3 (call "plug" hereafter) as a terminal with an end of a shielded wire 2 as an electric wire.

Figure 2:
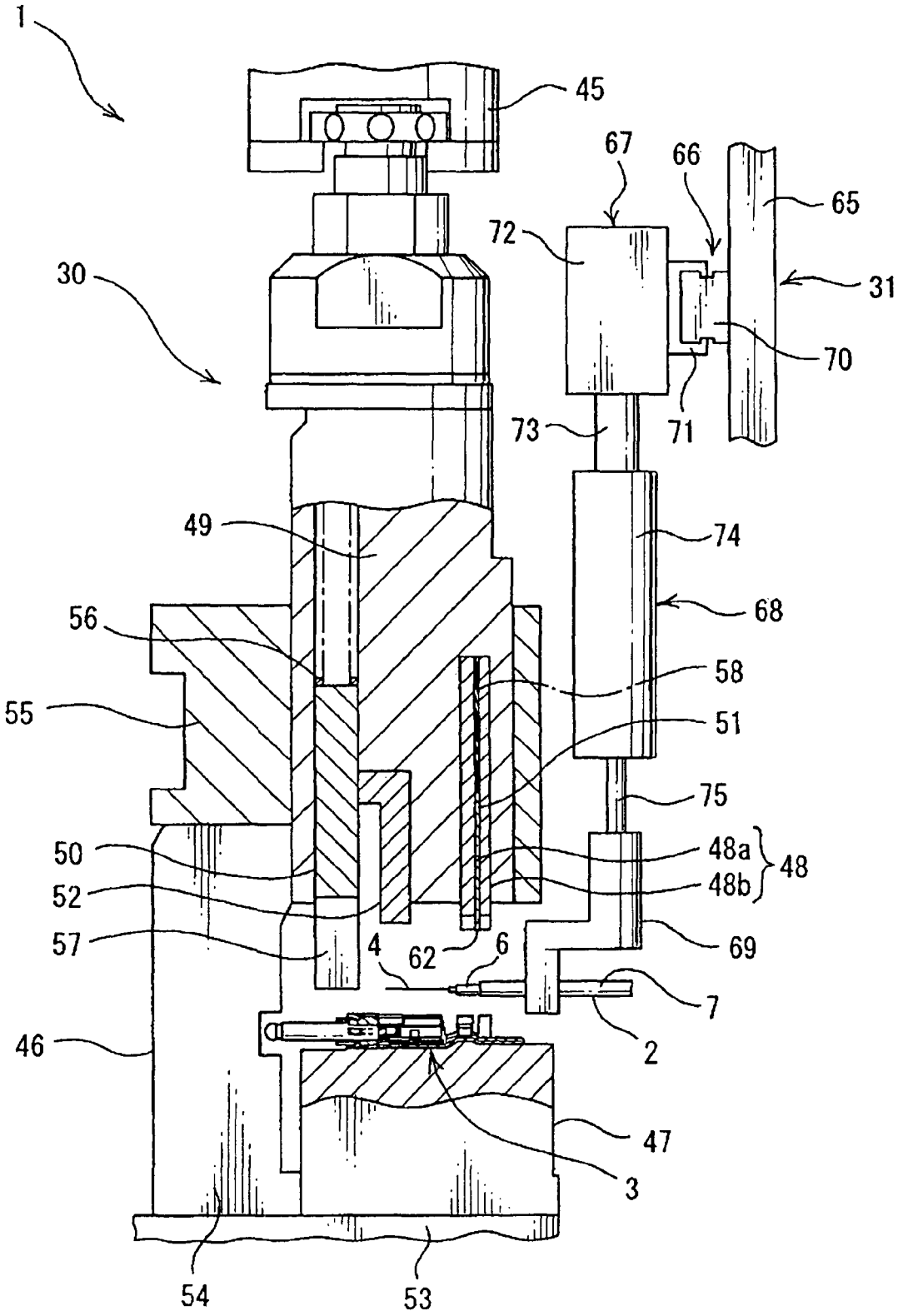
FIG. 2 is a partially cross-sectional side view illustrating an applicator of the terminal crimping apparatus shown in FIG. 1.

As shown in FIG. 2, the shielded wire 2 is made of a conductor core 4 as a core, and an insulator 5 covering the conductor core 4, and a conductive braid 6 covering the insulator 5, and an insulating sheath 7 covering the conductive braid 6 as an outer cover.

The conductor core 4 is made of electrically conductive metal and formed linearly with a circular cross-section. The insulator 5 is made of electrically insulating synthetic resin. The conductive braid 6 is made of a plurality of strands of conductive metal braided in a net like formula. The insulating sheath 7 is made of electrically insulating synthetic resin. At the end of the shielded wire 2 with the mentioned feature, each of the insulating sheath 7 and the conductive braid 6 and the insulator 5 is partially removed and the conductor core 4 and the conductive braid 6 and the insulator 5 are exposed at the end.

Figure 12:
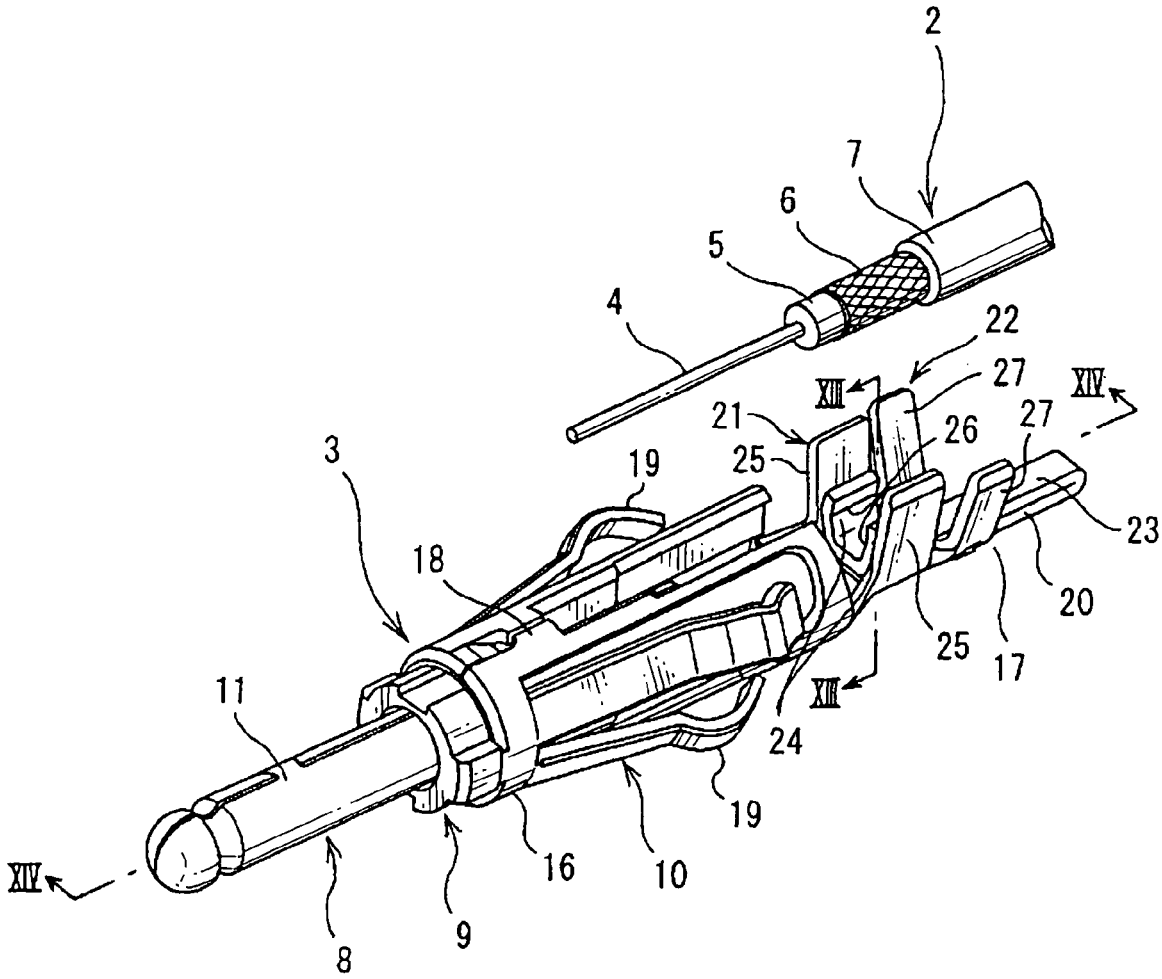
FIG. 12 is a perspective view of an end of a shielded wire being crimped to a plug by the terminal crimping apparatus shown in FIG. 1.
Figure 13:
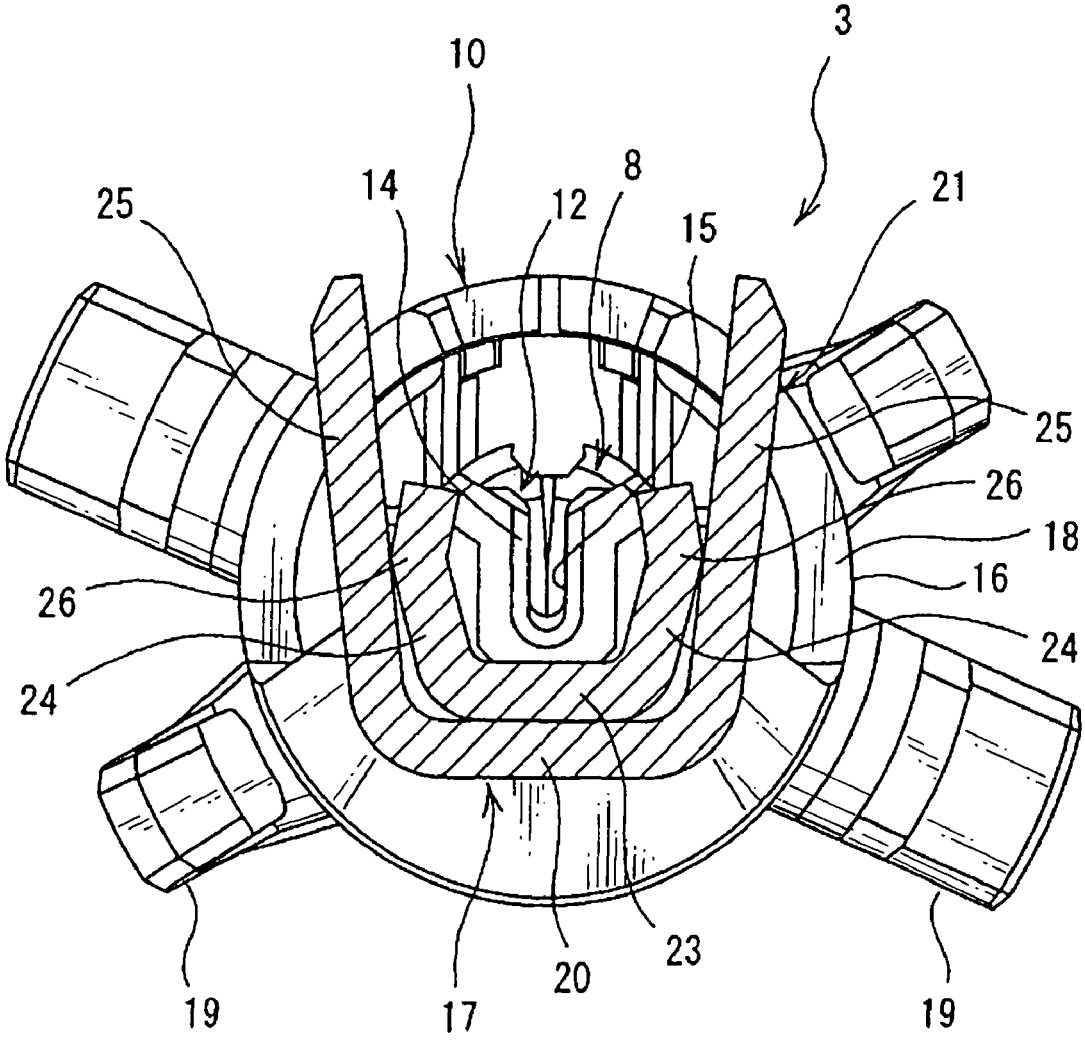
FIG. 13 is a cross section view of line XIII-XIII shown in FIG. 12.
Figure 14:
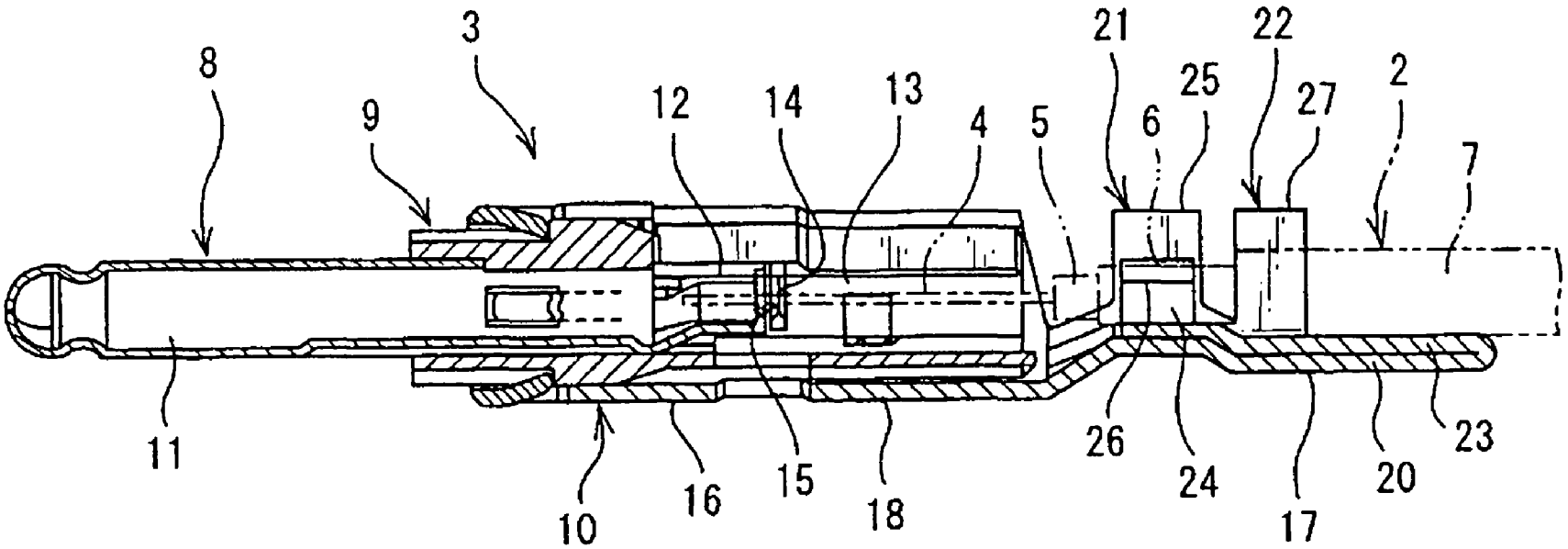
FIG. 14 is a cross section view of line XIV-XIV shown in FIG. 12.

As shown in FIGS. 12-14, the plug 3 has a plug pin 8 made of electrically conductive metal and an insulation housing 9, and an external contact 10 made of electrically conductive metal. The plug pin 8 is made by bending a sheet metal.

As shown in FIG. 12 and 14, the plug pin 8 has an electric contact portion 11 and a pressure-contact portion 12. The electric contact portion 11 is formed into a cylindrical shape so as to be inserted in electrical equipment such as a base of an antenna of a motor vehicle and connected with the electric equipment.

The pressure-contact portion 12 has a main body 13 with a c-shaped cross-section, which is continued to an outer surface of the electrically contact point 11 and a contact blade 14 standing from an inner surface of the main body 13. A slit 15 is arranged at the contact blade 14. The slit 15 is arranged from the nearer end of the opening of the main body 13, extending straightly along a direction of standing the contact blade 14. The conductor core 4 that is, the shield wire 2 is pressure-contacted with the pressure-contact portion 12 by pressing the conductive core 4 into the slit 15 of the contact blade 14. By this way, the pressure-contact portion 12 that is, the plug pin -8 is electrically connected with the conductor core 4.

The insulation housing 9 is formed into a cylindrical shape and is made of electrically insulating synthetic resin. The insulation housing 9 is press-fitted-to the outer surface of the pressure-contact portion 12 of the plug pin 8. The insulation housing 9 electrically insulates the plug pin 8 from the external contact 10.

The external contact 10 is made by bending a metal plate. The external contact 10 has a fixing portion 16 and a wire connecting portion 17.

The fixing portion 16 has a cylindrical main body 18 and a plurality of connecting pieces 19. The main body 18 is engaged with the insulating housing 9, by press-fitting with the outer surface of the insulating housing 9. An end of the connecting piece 19 is continued to the main body 18, and the other end thereof is elongated in a direction of separating from the plug pin 8. The connecting piece 19 curves from the end toward the other end, to be apart from the plug pin 8. The connecting pieces 19 fixes the plug 3 on the electric equipment by engaging with an inner surface of a connecting hole of the electric equipment such as a base of the antenna.

The wire connecting portion 17 includes a sheath crimping portion 22, and a braided crimping portion 21, and a bottom plate 20 connected with an outer surface of the main body 18 of the fixed portion 16. The bottom plate 20 is in a plane rectangular shape and an end of the bottom plate is continued to the main body 18 of the fixed portion 16, elongated in the direction of parting the plug pin 8 and the main body 18.

The braided crimping portion 21 includes a pair of outer crimping pieces 25, and a pair of inner crimping pieces 24, and a bottom plate 23 for the braid placed over the bottom plate 20. The bottom plate 23 for the braid is in a flat rectangular shape, placed over the bottom plate 20.

The pair of inner crimping pieces 24 stands up from the rim of the bottom plate 23 in the width direction. As shown in FIG. 13, a curved portion 26 is formed at the central area of the inner crimping pieces 24 so as to make ends separated from the bottom plate of the curved portion 26 approach each other.

The pair of outer crimping pieces 25 stands up from the outer rim of the bottom plate 20 in the width direction, surrounding the inner crimping pieces 24. Namely, the pair of outer crimping pieces 25 places the pair of inner crimping pieces 24 therebetween.

As for the braided crimping portion 21, the braided conductors 6 exposed from an end of the shielded wire 2 are piled on the bottom plate 23 and the crimping pieces 24, 25 are bent in the direction approaching the bottom plate 20, 23.

The braid crimping portion 21 crimps the braided conductor 6 of a shielded wire 2 by crimping the braided conductor 6 of a shielded wire 2 between the crimping pieces 24,25 and the bottom plate 20,23.

The sheath crimping portion 22 has a pair of sheath crimping pieces 27. The sheath crimping pieces 27 are placed at the outer rim of the bottom plate along in the width direction and placed apart from the plug pin 8 than the crimping pieces 24,25.

The sheath crimping portion 22 is bent in the direction of the sheath crimping pieces 27 approaching the bottom plate 20. The sheath crimping portion 22 crimps the insulating sheath 7 of a shielded wire 2 by placing the insulating sheath 7 of a shielded wire 2 in between the crimping piece 27 and the bottom plate 20.

As for the external contact 10, the main body 18 of the fixed portion 16 is attached to the insulating housing 9, the braided crimping portion 21 crimps the braided conductor 6, and the sheath crimping portion 22 crimps the insulating sheath 7 so that the external contact 10 is fixed to both the shielded wire 2 and the insulating housing 9.

Further, the external contact 10 is electrically connected with the braided conductor 6 of the shielded wire 2.

The insulating housing 9 is coupled with an outer periphery of the crimping portion 12 of the plug pin 8, and the main body 18 of the fixing portion 16 is coupled with an outer periphery of the insulating housing 9 so that the plug 3 is assembled.

Then, as for the plug 3, an end of the shielded wire 2 is allowed to approach the bottom plate 20, 23 along a direction crossing at right angles a surface of the bottom plate 20, 23.

After the braided conductor 6 is being placed on the bottom plate for the braid 23, where the exposed braided conductor 6 of the shielded wire 2 is placed in between the pair of inner crimping pieces 24 of the braid crimping portion 21, the crimping pieces 24,25,27 are bent towards the bottom plate 20,23 and crimps the braided conductor 6 and the insulating sheath 7 together while the conductor core 4 is press-fitted in between the slit 15 of the crimping blade 14 of the crimping portion 12. By this way, the plug 3 is attached to the end of the shielded wire 2 and connected to the electrical equipment.

Figure 1:
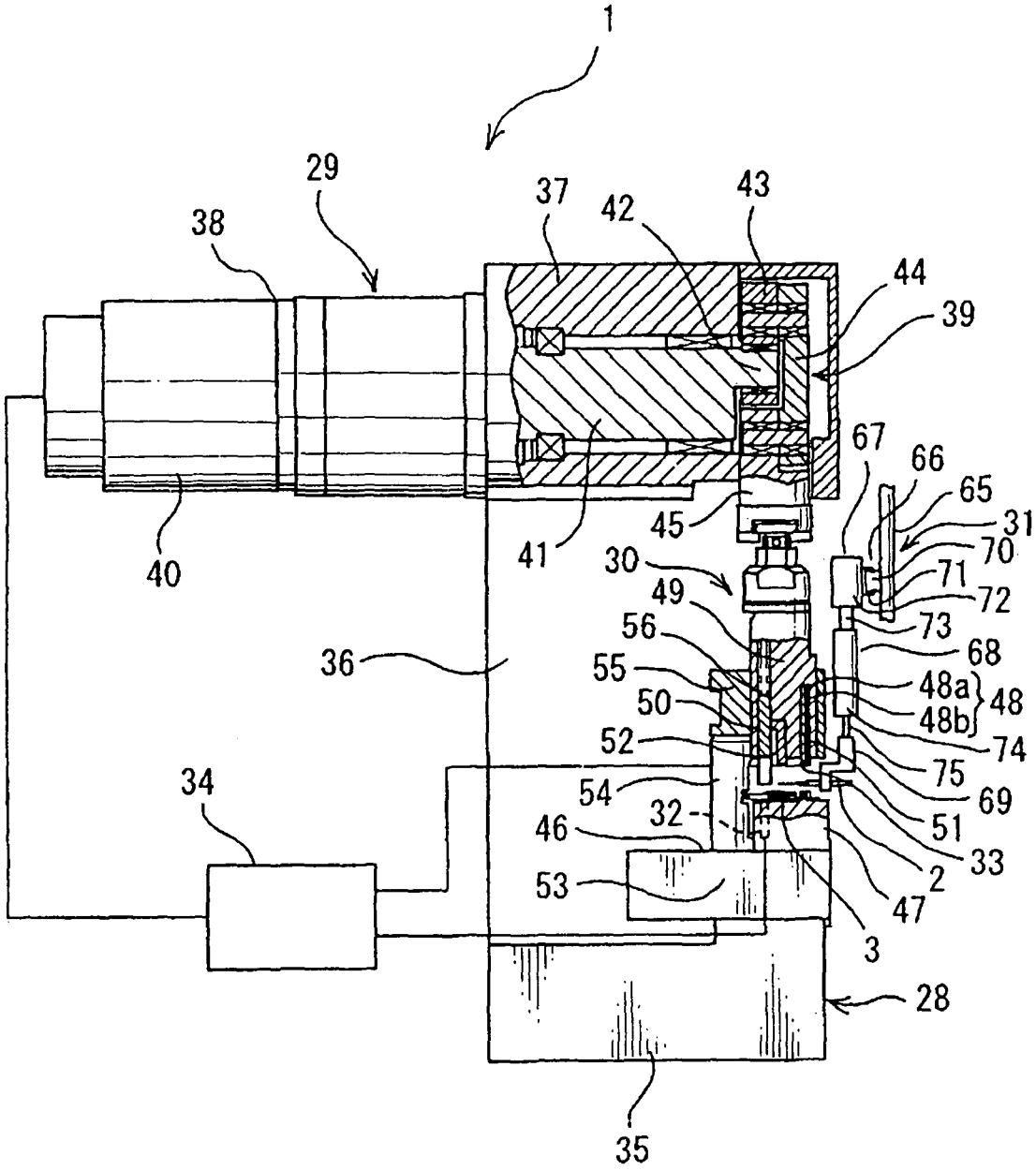
FIG. 1 is a partially cross-sectional side view illustrating a structure of a terminal crimping apparatus of an embodiment by the present.

As shown in FIG. 1, the terminal crimping apparatus includes a main body 28, a driving unit 29, an applicator 30, a wire carrying device 31, a first sensor 32 and a second sensor 33 as a detecting means, and a control device 34 as a controlling means.

The main body 28 has a bottom plate 35 and a vertical wall 36, which stands from the bottom plate 35, and a top wall 37, which is continued to the vertical wall 36. The bottom plate 35 and the top wall 37 are substantially in a flat shape in the horizontal direction and arranged parallel with each other.

The driving unit 29 includes a servomotor 38 as the driving unit and a link mechanism 39. In the figure shown, one servomotor is being arranged. The servomotor 38 has a main body 40 and an output shaft 41, rotatably provided to the main body. The servomotor 38 is a driving means for allowing a crimper 48, a wire inserting mold 51, and a positioning mold 50 as one piece to approach to and part from the anvil 47.

The link mechanism having a decenterized pin 42, a first link shaft 43, a second link shaft 44, and a sliding member 45. The decenterized pin 42 forms a cylinder shape, projecting from the end surface of the output shaft 41. The axel of the decenterized pin 42 is placed parallel with the axel of the output shaft with a space in between. In other word, the decenterized pin 42 is not coaxially placed with the axel of the output shaft 41 but decenterized with the axel of the output shaft 41.

One end of the first linking shaft 43 is rortatably engaged with the decenterized pin 42. The lengthwise direction of the first linking shaft 43 is positioned parallel with the vertical direction while the anvil 47 and the crimper 48 are in the furthest position apart. The second shaft 44 is placed over the first shaft 43 and the lengthwise direction of the second linking shaft 44 is positioned parallel with the vertical direction while the anvil 47 and the crimper 48 are in the furthest position apart. An end of the second linking shaft 44 and the opposite end of the first linking shaft 43 are rotatably engaged with each other. The sliding member 45 is slidably supported by the top wall 37 in the vertical direction. The slinding member 45 partially projects from the top wall 37. The sliding member 45 is rotatably attached to the opposite end of the second shaft 44.

In the mentioned linking mechanism 39, when the output shaft 41 of the servomotor 38 rotates, the sliding member 45 slides vertically by the deceterlized pin 42 and by the linking shaft 43,44. The linking mechanism 39 moves the anvil 47 and the crimper 48 in the direction of approaching and parting by sliding the sliding member 45 in the vertical direction with the driving force of the servomotor 38.

Figure 3:
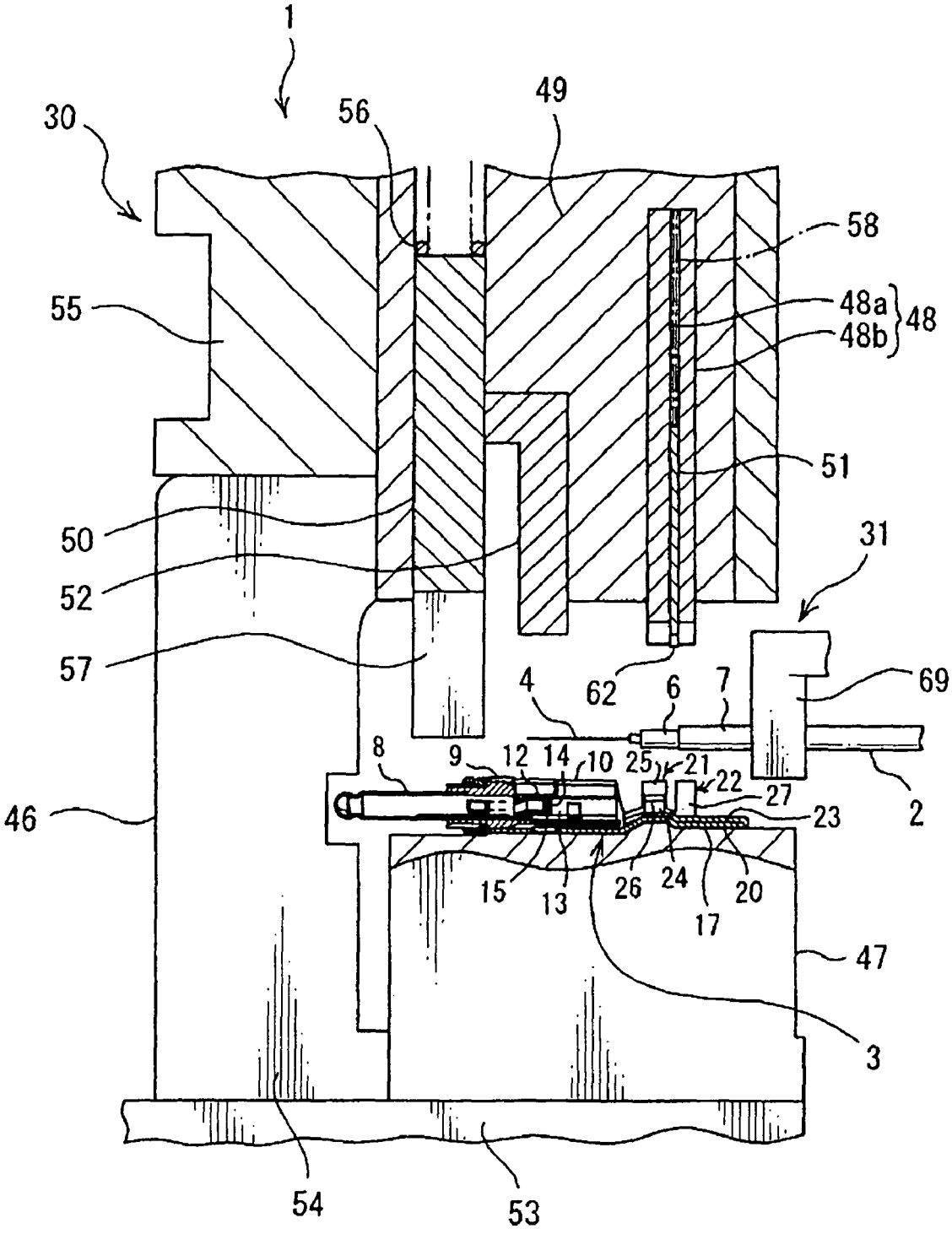
FIG. 3 is a partially cross-sectional side view illustrating the main components of the applicator shown in FIG. 2.

The applicator 30 is arranged on the bottom plate 35 of the main body 28. As shown in FIG. 2, and 3, the applicator has a frame 46, a bottom part 47 as the first die (from hereunder referred to as an "anvil"), and an upper part 48 as the second die (from hereunder referred to as a "crimper"), and a RAM 49, a positioning mold 50, a wire inserting mold 51 as the third die, and a crimping portion 52 as the crimping portion of the electric wire.

The side viewed shape of the frame 46 is substantially a transpositioned U shape. The frame 46 is placed on the bottom plate 35 of the main body 28. The frame 46 has an anvil holding portion 53, up-directed portion 54, and a RAM holding portion 55. The anvil holding portion 53 is placed on the bottom plate 35 of the main body 28.The anvil holding portion 53 fixes the anvil 47.

The up-directed portion 54 extends upwards from the anvil holding portion 53 towards the top wall 37. The RAM holding portion 55 is engaged with the upper end of the up-directeded portion 54. The RAM holding portion 55 holds the RAM 49, freely elevating the RAM 49 upwards and downwards. Namely, the RAM holding portion 55 slidably holds the RAM 49 in the direction of approaching and parting the anvil 47 and the crimper 48.

The anvil 47 is fixed to the anvil holding portion 53 so as to be attached to a frame 46. The plug 3 is placed on the anvil 47. The plug 3 is placed onto the anvil 47 while the anvil 47 comes in contact with the bottom plate 20. The crimping pieces 24,25,27 of the plug 3 placed on the anvil 47 extending upwards from the anvil 47.

The RAM 49 is substantially in a cubic shape. The RAM 49 is supported by the RAM holding portion 55 in which is movable in the vertical direction. The lengthwise direction of the RAM 49 is parallel with said movable direction, in other word, in the vertical direction. The upper part of the RAM is attached to the sliding member 45 and the RAM 49 is moved by the driving force of the servomotor 38. (The anvil 47 and the crimper 48 slide along the direction of approaching and parting each other).

The crimper 48 is attached to the RAM 49, provided in the vertical direction facing the anvil 47.

The RAM 49 is supported movabley up and down by the RAM holding portion 55, so that the crimper 48 is supported by the anvil 47 in the direction of approaching to and parting from the anvil 47.

The crimper 48 is displaced in the vertical direction and moves in the direction of approaching to and parting the anvil 47. Namely, the RAM moves up and down interlocking with the movement of the crimper 48, moving in the direction of approaching to and parting from the anvil 47.

The crimper 48 includes a first crimper 48*a* and a second crimper 48*b*. The first crimper 48*a* and the second crimper 48*b* are in a position relatively facing with each other along the vertical direction of the anvil 48. The first crimper 48*a* faces the crimping pieces 24 of the crimping portion 21 of the plug 3, which is set on the anvil 47, and approaches and leaves the crimping pieces 24, 25 of the crimping portion 21 when the RAM 49 moves up and down.

The first crimper 48*a* moves towards the crimping pieces 24,25 of the crimping portion 21 and bends the crimping pieces 24,25 of the crimping portion 21 in the direction of approaching the bottom plate 20,23 and the braid conductor 6 of the shielded wire 2 is crimped by the crimping pieces 24,25 of the crimping portion 21.

The second crimper 48*b* faces the crimping pieces 27 of the sheath crimping pieces 27 of the plug 3, which is set on the anvil 47, and approaches and leaves the sheath crimping pieces 27 when the RAM moves up and down. The second crimper 48*b* moves towards the sheath crimping pieces 27 and bends the sheath crimping pieces 27 in the direction of approaching the bottom plate 20 and the sheath crimping pieces 27 crimps the insulating sheath 7 of the shielded wire 2.

The positioning mold 50 is supported by the RAM 49, slidably in the vertical direction. Namely, the positioning mold 50 is arranged slideable to the crimper 48. A part of the positioning mold 50 projects from the RAM 49 towards the anvil 47 and is prevented from falling off downward from the RAM 49 by the RAM 49 and others. The positioning mold 50 is shaped in a pole-shape, extending in the vertical direction. The positioning mold 50 is urged towards the plug 3 of the anvil 47 by a sprig 56 acting as an urging means. When the anvil 47 and the crimper 48 is in a position distanced apart from each other, the positioning mold 50 projects more from the RAM 49 towards the anvil 47 than the crimper 48*a*, 48*b*.

Figure 7:
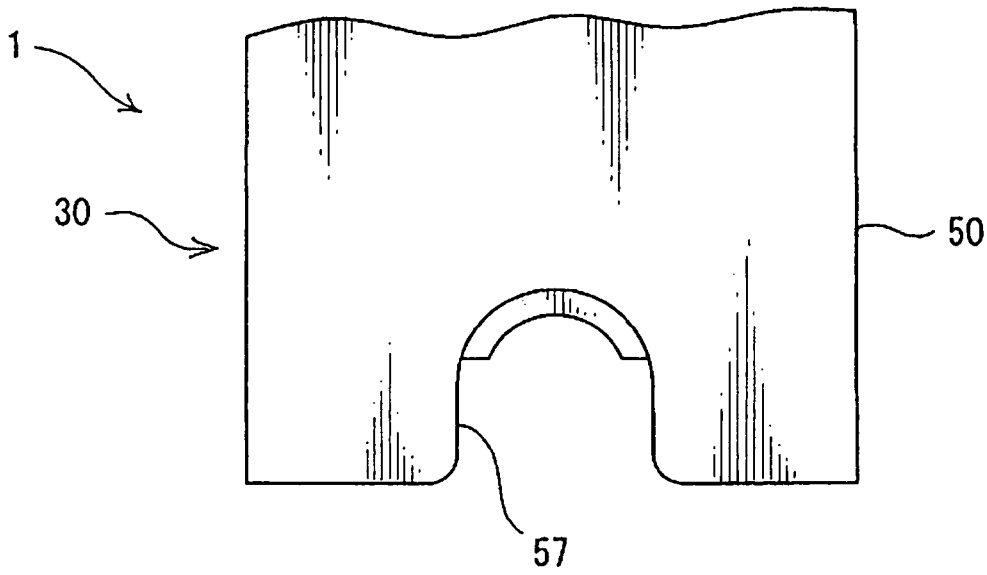
FIG. 7 is an explanative illustration showing a relative position of the positioning jig and the anvil of the applicator shown in FIG. 3.
Figure 7:
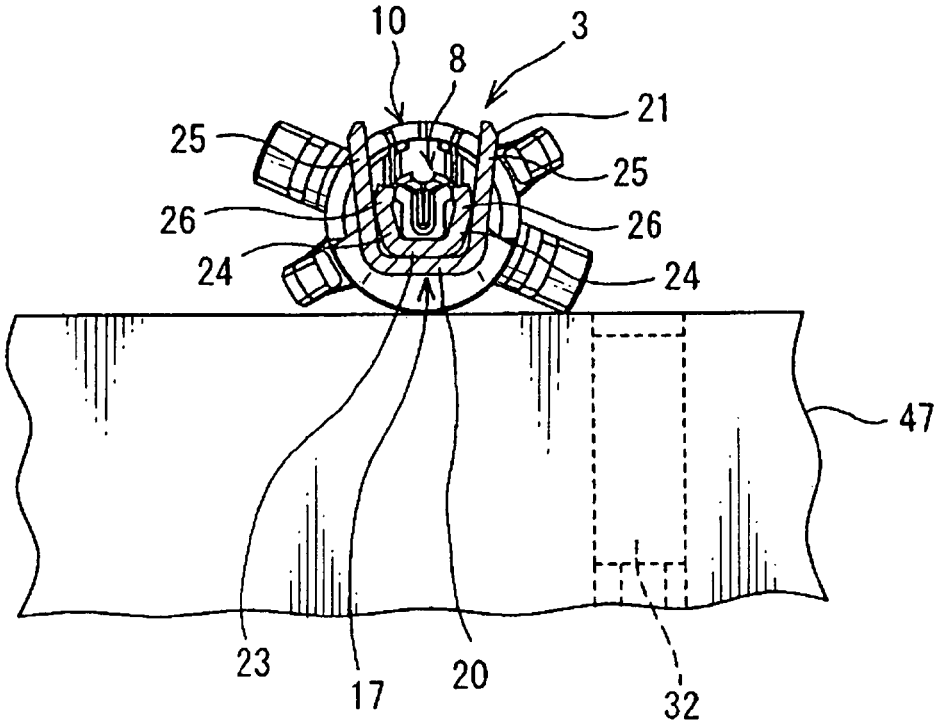
Figure 8:
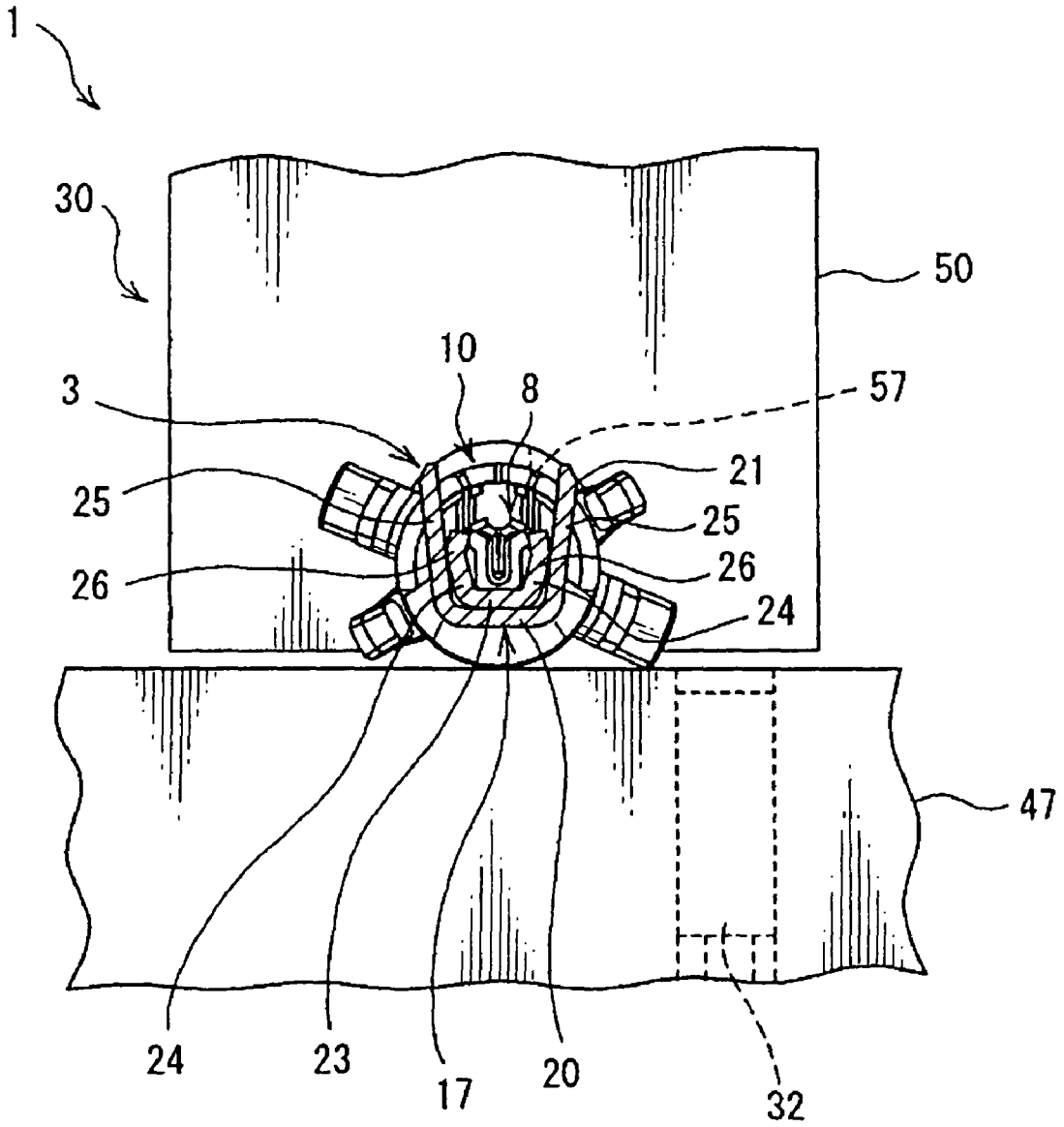
FIG. 8 is an explanative illustration showing the relative position of the positioning jig and the anvil of the applicator shown in FIG. 4.

Further, as shown in FIG. 7 the positioning mold 50 faces the plug pin 8 of the plug 3, which is placed on the anvil 47, along in the direction of the anvil 47 and the crimper 48 approaching to and parting from and with each other, namely, in the vertical direction.

As shown in FIG. 7, at the end near the anvil 47 of the positioning mold 50 a positioning dent 57 is arranged. The positioning dent 57 is dented at the surface end, near to the anvil 47 of the positioning mold 50. When the RAM 49 descends and the anvil 47 and the crimper 48 approaches each other, the plug pin 8 of the plug 3 which is placed on the anvil 47 is positioned inside the positioning dent 57. When the RAM 49 descends before the wire inserting mold 51 inserts the braided conductor 6 of the shielded wire 2 in between the pair of crimping pieces 24, and before the crimper 48*a*, 48*b* crimps the crimping pieces 24,25,27, the positioning mold 50 positions the plug pin 8 of the plug 3 inside of the positioning dent 57, placing the plug pin 8 of the plug 3 between the anvil 47. Which means that the positioning mold 50 positions the plug 3 by putting the plug pin 8 of the plug 3 between the anvil 47.

The wire-inserting mold 51 is attached to the RAM 49 slideably in the vertical direction. Namely, the wire-inserting mold 51 is arranged slideable to the crimper 48. The wire-inserting mold 51 is prevented from falling off from the RAM 49, by the RAM 49 supporting the wire-inserting mold 51 with a part of the wire-inserting mold 51 supported in a position projecting towards the anvil 47. The wire-inserting mold 51 is urged towards the plug 3 which is placed on the anvil 47 by an urging means, such as the spring 58. The wire-inserting mold 51 is placed between the crimpers 48*a*, 48*b*. When the anvil 47 and the crimper 48 is in a position distanced apart from each other, the wire-inserting mold 51 projects from the RAM 49 towards the anvil 47 more than the crimpers 48*a*, 48*b*, and projects less towards the anvil 47 than the positioning mold 50 from the RAM 49.

Further, the wire-inserting mold 51 is directed in the direction of the anvil 47 and the crimper 48 approaching and parting, vertically facing the space between the crimping portions 21,22 of the plug 3, which is placed on the anvil 47. In other words, the wire-inserting mold 51 approaches to and parts from the space between the crimping portions 21,22 of the plug 3, which is placed on the anvil 47.

Figure 9:
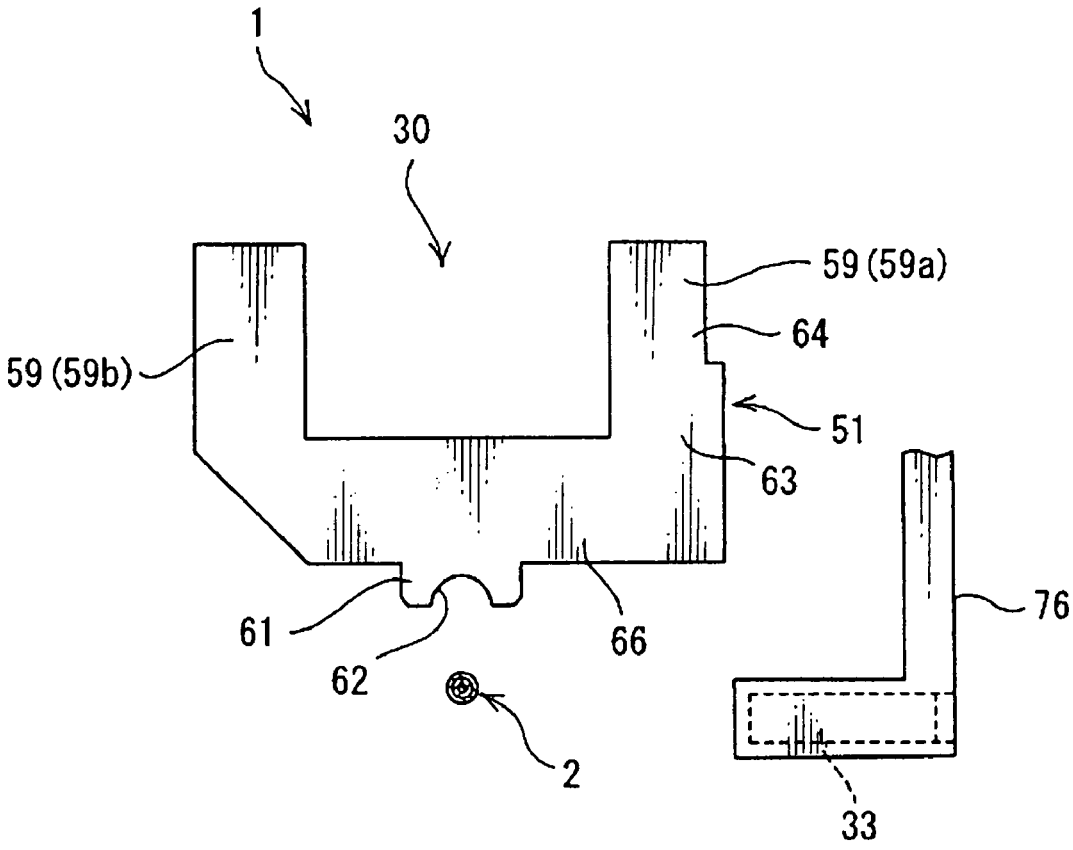
FIG. 9 is an explanative illustration showing the relative position of the wire-inserting die and the anvil of the applicator shown in FIG. 3.
Figure 9:
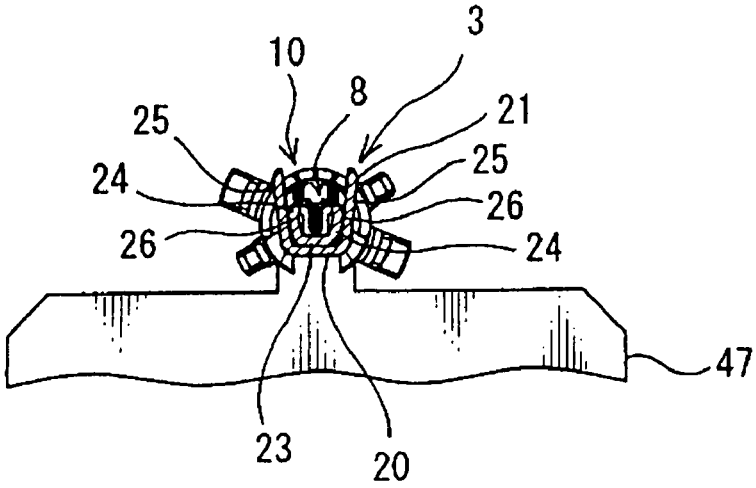

As shown in FIG. 9, the wire pressing mold 51 consists of, a pair of parallel portions 59 positioned parallel with each other, and a linking plate 60 which links the pair of parallel portions 59 together, and a wire inserting portion 61. The lengthwise direction of the parallel portion 59 is parallel with the vertical direction. The linking portion 60 links the lower portion of each of the parallel portion 59. The wire inserting portion 61 is arranged substantially in the middle of the linking portion 60, projecting from the linking portion 60 towards the anvil 47. A wire positioning dent 62 is arranged on the wire inserting portion 61. The wire positioning dent 62 is dented in an arc shape at the edge near towards the anvil 47 of the wire inserting portion 61. When the RAM 49 descends and the anvil 47 and the crimper 48 moves close with each other the braid conductor 6 exposed at the end of the shielded wire 2 is held by a chuck 69 of a wire carrying device 31 and positioned inside of the wire positioning dent 62.

When the RAM 49 descends, the wire-inserting mold 51 presses the braided conductor 6 of the shielded wire 2, which is held by the chuck 69 in the direction of the plug 3, placed on the anvil 47. Before the crimpers 48*a*, 48*b* crimps the crimping pieces 24, 25, 27, the wire-inserting mold 51 inserts the braid conductor 6 of the shielded wire 2 between the pair of crimping pieces 24 by pressing the braided conductor 6 of the shielded wire 2 towards the bottom plate 23.

A wide portion 63 and a narrow portion 64 is arranged on one of the parallel portion 59*a* of the wire inserting mold 51, and the inner edges of the wide portion 63 and the narrow portion 64 faces the other parallel portion 59*b* of the wire inserting mold 51, and are arranged in one plane. Needless to say, the wide portion 63 is arranged wider in width than the narrow portion 64. On one of the parallel portion 59*a* a cut out is arranged by cutting out a part of the outer edge of the parallel portion 59*a*.

The pressure-contact mold 52 is formed into a plate shape and fixed to the RAM 49. The pressure-contact mold 52 projects more towards the anvil 47 than the RAM 49. The pressure-contact mold 52 faces the anvil 47 along the vertical direction while facing the conductor core 4 exposed at the end of the shielded wire 2, which is fixed to the chuck 69. The pressure-contact mold 52 is directed towards the pressure-contact portion 12 of the plug 3 on the anvil 47 in the vertical direction (i.e. in the direction of the anvil 47 and crimper 48 approaching and parting) and inserts the conductor core 4 of the shielded wire 2 in the pressure-contact portion 12.

When the RAM 49 moves up and down, the pressure-contact mold 52 is moved in the direction of approaching and parting the pressure-contact portion 12 of the plug 3. The pressure-contact mold 52 crimps the conductor core 4 with the pressure-contact portion 12 by approaching together with the crimper 48, towards the anvil 47 and inserts the conductor core 4 of the shielded wire 2, which is fixed to a chuck 69, in between the slit 15 of the pressure-contact blade 14 of the pressure-contact portion 12.

As the structure mentioned, the applicator 30 moves the anvil 47 and the crimper 48 close with each other with the driving force of the servomotor 38, and the positioning mold 50 positions the plug 3 on the anvil 47, and then, the applicator 30 further drives the servomotor 38, moving the anvil 47 and the crimper 48 close with each other and inserts the braided conductor 6 of the shielded wire 2 which is fastened to the chuck 69 of the wire carrying device 31, in between the pair of inner crimping pieces 24 of the braid crimping portion 21 by pressing the braided conductor 6 of the shielded wire 2 with the wire inserting mold 51 towards the direction of the bottom plate.

Then, the applicator 30 further drives the servomotor 38, moving the anvil 47 and the crimper 48 close with each other, and crimps the braid conductor 6 of the shielded wire 2 and the insulating sheath 7 to the plug 3, by bending the crimping pieces 24, 25,27 towards the direction of the bottom plate 20,23 with the crimpers 48*a*, 48*b*, while inserting the conductor core 4 of the shielded wire 2 in between the slit 15 of the pressure-contact blade 14 of the pressure-contact portion 12, with the pressure-contact mold 52. As mentioned, by the driving force of the servomotor 38 the applicator 30 moves the anvil 47 and the crimper 48 close with each other while an end of the shielded wire 2 and the plug 3 is placed between the anvil 47 and the crimper 48, and crimps an end of the shielded wire 2 to the plug 3.

While doing so, the crimping pieces 24,25 crimps the braided conductor 6 of the shielded wire 2 by bending the crimping pieces 24, 25 of the crimping portion 21 towards the bottom plate 20, 23, with the first crimper 48*a*. The sheath crimping pieces 27 crimps the insulating sheath 7 of the shielded wire 2 by the second crimper 48*b* bending the sheath crimping pieces 27 towards the bottom plate 20.

The distance between the crimper 48*a*, 48*b* and the anvil 47 changes in accordance to the outer diameter of the plug 3 and the shielded wire 2. For instance, when crimping an electric wire with a relatively large outer diameter, the crimpers 48*a*, 48*b* and the anvil 47 will be relatively distanced apart, and when crimping an electric wire with a relatively small outer diameter, the distance between the crimper 48*a*, 48*b* and the anvil 47 will be relatively close.

As shown in FIG. 2, a wire carrying device 31 consists of, a vertical wall 65, a linier guide 66, a driving means (not shown) for the sliding movement, a fluctuating cylinder 67, a chuck cylinder 68, and the pair of chuck 69.

The vertical wall 65 is arranged as standing vertically from the bottom plate 35 of the main body 28. The linier guide 66 has a rail 70 and a slider 71. The rail 70 extends in a straight line. The rail 70 is attached to the vertical wall 65. The lengthwise direction of the rail 70 is parallel with the horizontal direction. The slider 71 is attached to the rail 70, slideably along the lengthwise direction of the rail 70. The driving means for the sliding movement moves the slider 71 in the lengthwise direction of the rail 70.

The fluctuating cylinder 67 has a cylinder body 72 and a rod 73, which is arranged free to move up and down from the cylinder body 72. The cylinder body 72 is attached to the slider 71 of the linier guide 66. The cylinder body 72 is attached to the slider 71 in a position where a projecting rod 73 moves downward in the vertical direction from the cylinder body 72.

The chuck cylinder 68 consists of, a cylinder main body 74, and a pair of chuck rods 75. The cylinder main body 74 is attached to the projecting rod 73 of the fluctuating cylinder 67. The pair of chuck rods 75 extending parallel with each other in a straight line. The chuck cylinder 68 moves each of the chuck rods 75 in the direction of approaching and parting each other. The chuck cylinder 68 is arranged in a position where the pair of chuck rods 75 extends downward from the cylinder main body 74, and the longitudinal edge of the chuck rods 75 are positioned parallel with the vertical axis. The chucks 69 are each attached to the chuck rods 75. The insulating sheath 7 of the shielded wire 2 is put in between the pair of chucks 69, and the chuck cylinder 68 moves the pair of chucks 69 in the direction of approaching and parting each other.

The wire carrying device 31 with the aforementioned structure moves the chuck cylinder 68 along the rail 70 of the linear guide 66 along the lengthwise direction of the rail 70, while the projecting rod 73 of the fluctuating cylinder 67 extends and retracts. Each one of the pair of chuck rods 75 of the chuck cylinder 68 moves in the direction of approaching to and parting from each other and places the shielded wire 2 with the insulating sheath 7, or the braided conductor 6 removed at the end, which is held by a rod (not shown) in between the chucks 69. Thereafter, the wire carrying device 31 carries the shielded wire 2 from the rod 73 to the applicator 30 by the chuck cylinder 68 moving along in the longitudinal length of the rail 70 of the linear guide 66. Thereafter, an end of the shielded wire 2, which is held between the chuck 69 is positioned on top of the plug 3, which is placed on the anvil 47, by the wire carrying device 31. Likewise, the wire carrying device 31 carries the shielded wire 2, one by one from a rod (not shown) to the applicator 30.

As shown in FIG. 7, the first sensor 32 is arranged on the anvil 47. In the figure, the first sensor 32 is a proximity switch, which detects whether or not the positioning mold 50 has correctly positioned the plug 3 onto the anvil 47. The first sensor 32 detects the existence of the positioning mold 50 when the positioning mold 50 correctly positions the plug 3 inside the positioning dent 57 having the plug 3 abutting against the anvil 47. The first sensor 32 does not detect the existence of the positioning mold 50 when the positioning mold 50 fails to position the plug 3 correctly inside the positioning dent 57, and when the plug 3 is distanced from the anvil 47. The first sensor 32 detects whether or not the positioning mold 50 has positioned the plug 3 inside the positioning dent 57 or if the plug 3 is positioned onto the anvil 47, by detecting the existence of the positioning mold 50.

As shown in FIG. 9, a second sensor 33 is attached to an attachment 79 of a device body 28. The sensor attachment 79 is fixed to the device body 28, aligned along a radial direction of the plug 3, which is placed on the anvil 47, and also aligning with one of the parallel portion 59*a* having a wide portion 63 and a narrow portion 64 for the wire-inserting mold 51, namely, the parallel portion 59*a* with a cut-out.

The second sensor 33 is arranged in a position aligning with one of the parallel portion 59*a* of the wire inserting mold 51 and the plug 3, namely, in the radial direction of the shielded wire 2. Further, the second sensor 33 is placed in between the anvil 47 and the wire-inserting mold 51 which is in a positioned furthest apart from the anvil 47 vertically (in the direction of anvil 47 and crimper 48 approaching and parting).

In the figure, the second sensor 33 is a proximity switch detecting whether or not the wire inserting mold 51 is in a position where the braided conductor 6 of the shielded wire 2 is inserted between the pair of crimping pieces 24 of the braid crimping portion 21. The second sensor 33 detects the existence of the wide portion 63, when the braided conductor 6 of the shielded wire 2 positioned inside of the wire positioning dent 62 by the wire inserting mold 51, is inserted in between the pair of crimping pieces 24, and when the wide portion 63 of one of the parallel portion 59*a* of the wire inserting mold 51 faces the second sensor 33.

The second sensor 33 does not detect the existence of the wide portion 63, when the braid conductor 6 of the shielded wire 2 placed inside of the wire positioning dent 62 by the wire inserting mold 51, runs on to one of the crimping piece 24 and the narrow portion 64 of one of the parallel portion 59*a* of the wire inserting mold 51 faces the second sensor 33. The second sensor 33 detects whether or not the braided conductor 6 of the shielded wire 2 is correctly inserted between the pair of inner crimping pieces 24 by detecting the existence of the wide portion 63 of the wire-inserting mold 51.

The control device 34 is a computer with the well-known ROM, RAM, CPU, which is connected to the mentioned servomotor 38 of the actuating portion 29, or with the sensors 32,33 and such, which controls the connected devices and controls the terminal crimping apparatus 1 as a whole.

The ROM memorizes the program movement of the CPU (i.e. the terminal crimping apparatus 1). The RAM temporary contains the data, while the CPU executes an operation. The CPU commands the terminal crimping apparatus 1 to operate accordingly with the programmed movement, memorized by the ROM. When crimping the plug 3 to the end of a shielded wire 2, the CPU first drives the servomotor 38, moving the RAM 49 towards the anvil 47 to a place where the positioning mold 50 places the plug 3 into the positioning dent 57, and the plug 3 abutting against the anvil 47.

When the CPU receives an information indicating the existence of the positioning mold 50, detected and sent by the first sensor 32, the CPU further drives the servomotor 38 and moves the RAM 49 towards the anvil 47. If the CPU does not receive an information indicating the existence of the positioning mold 50 from the first sensor 32, the CPU stops the servomotor 38 and sends a signal of an error (indicating the plug 3 not being positioned by the positioning mold 50) to an output device connected to the control device 34. The CPU then commands the output device to output a signal of error indicating the plug 3 not being positioned correctly by the positioning mold 50.

The CPU further drives the servomotor 38 and moves the RAM 49 towards the anvil 47 to a place where the wire inserting mold 51 inserts the braid conductor 6 of the shielded wire 2, which is placed inside the wire positioning dent 62, in between the pair of crimping pieces 24.

When the CPU receives an information indicating the existence of the wide portion 63 of one of the parallel portion 59*a* of the wire inserting mold 51, detected and sent by the second sensor 33, CPU further drives the servomotor 38, moving the RAM 49 towards the anvil 47. If the CPU does not receive an information indicating the existence of the wide portion 63 on one of the parallel portion 59*a* of the wire inserting mold 51 from the second sensor 33, the CPU stops the servomotor 38 and sends an information of an error (indicating the wire inserting mold 51 has failed to insert the braided conductor 6 of the shielded wire 2 in between the pair of inner crimping piece 24) to the output device. The CPU then commands the output device to output a signal of an error, indicating the wire-inserting mold 51 has failed to insert the braided conductor 6 of the shielded wire 2 in between the pair of inner crimping piece 24.

The CPU further drives the servomotor 38 and crimps the shielded wire 2 with the plug 3, by bending the crimping pieces 24, 25, 27 with the anvil 47 and the crimper 48. The CPU then drives the servomotor 38, and parts the anvil 47 and the crimper 48 away from each other. By this way, the CPU drives the servomotor 38 in sequence and moves the anvil 47, the crimper 48, and the wire-inserting mold 51, closer in accordance to each of the working steps, in which the wire inserting mold 51 inserts the braided conductor 6 of the shielded wire 2 between the pair of crimping pieces 24, and the crimper 48 crimps the crimping pieces 24, 25, 27.

The procedure of crimping an end of the shielded wire 2 to the plug 3 by the aforementioned terminal crimping apparatus 1 will now be explained. As shown in FIG. 2 and 3, by using the servomotor 38, the anvil 47 and the crimper 48 are distanced furthest apart while one plug 3 is being placed onto the anvil 47. At the same time, the crimping portion 12 (i.e. an opening) arranged on the main body 13 of the plug pin 8 is placed on the opposite side of the pressure-contact mold 52 and the crimping pieces 24,25 of the braid crimping portion 21 is placed on the opposite side of the crimper 48*b*. The wire carrying device 31 places an end of a single shielded wire 2 which is taken from a rod between the anvil 47 and the crimper 48. Further, the positioning mold 50 is spaced apart at the opposite side of the plug 3 placed on the anvil 47, as shown in FIG. 7, and the wire inserting mold 51 is also spaced apart at the opposite side of the plug 3 placed on the anvil 47, as shown in FIG. 9.

The CPU of the control device 34, then moves the servomotor 38 of the applicator 30, gradually moving the anvil 47 and the crimper 48 close together. Then, the positioning mold 50 gradually approaches towards the plug 3 placed on the anvil 47, and gradually inserts the plug 3 into the positioning dent 57. The plug 3 inserted into the positioning dent 57 is then positioned by the positioning mold 50 to the anvil 47. The first sensor 32 then detects the positioning mold 50 has placed the plug 3 in position of the anvil 47, and the CPU of the control device 34 further drives the servomotor 38, further moving the anvil 47 and the crimper 48 close with each other.

When the plug 3 is not correctly positioned on the positioning dent 57 and placed between the positioning mold 50 and the anvil 47, the positioning mold 50 presses the plug 3 placed on the anvil 47 in the direction of the RAM 49, whereby sinks the plug 3 into the RAM 49. Thereupon, the first sensor 32 detects the plug 3 not correctly positioned by the positioning mold 50 onto the anvil 47, and the CPU of the control device 34 stops the servomotor 38. Accordingly, the CPU commands the output device to output a signal o error, indicating the plug 3 not correctly positioned to the anvil 47.

Figure 4:
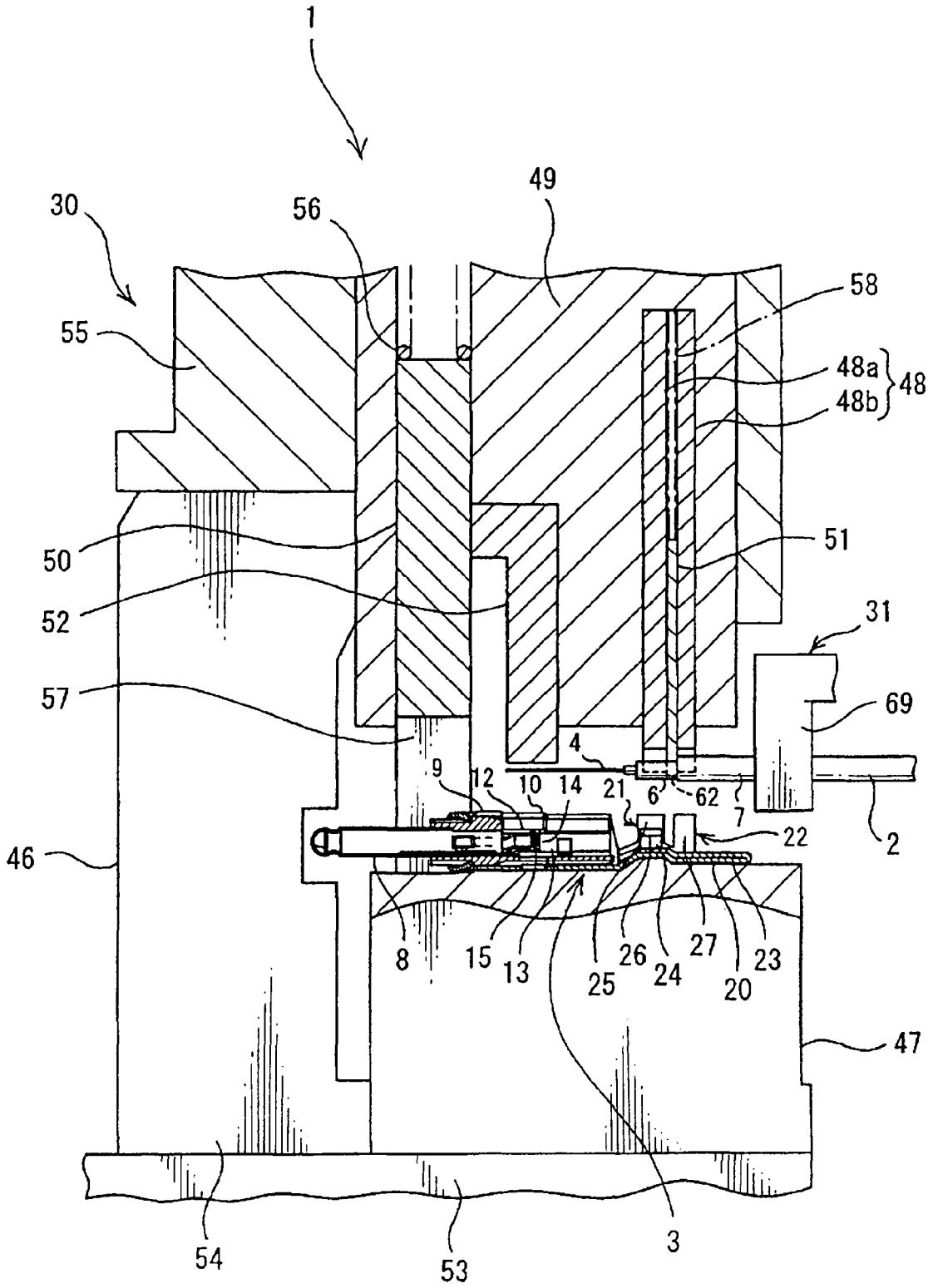
FIG. 4 is a partially cross-sectional side view illustrating a plug being positioned onto an anvil by a positioning jig of the applicator shown in FIG. 3.
Figure 5:
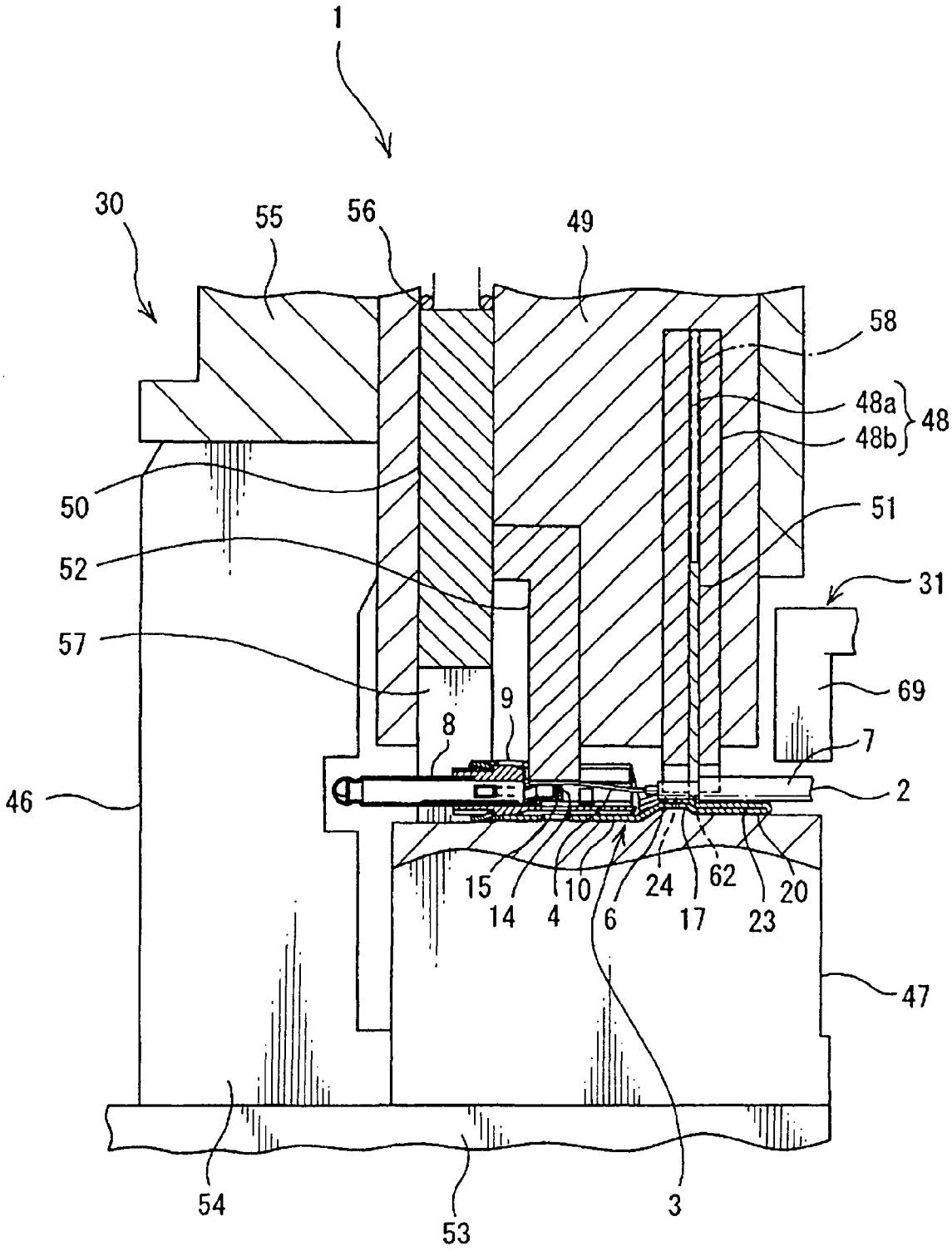
FIG. 5 is a partially cross-sectional side view illustrating a braided conductor of a shielded wire being inserted in between a pair of inner crimping piece by a wire pressing die of the applicator shown in FIG. 4.
Figure 6:
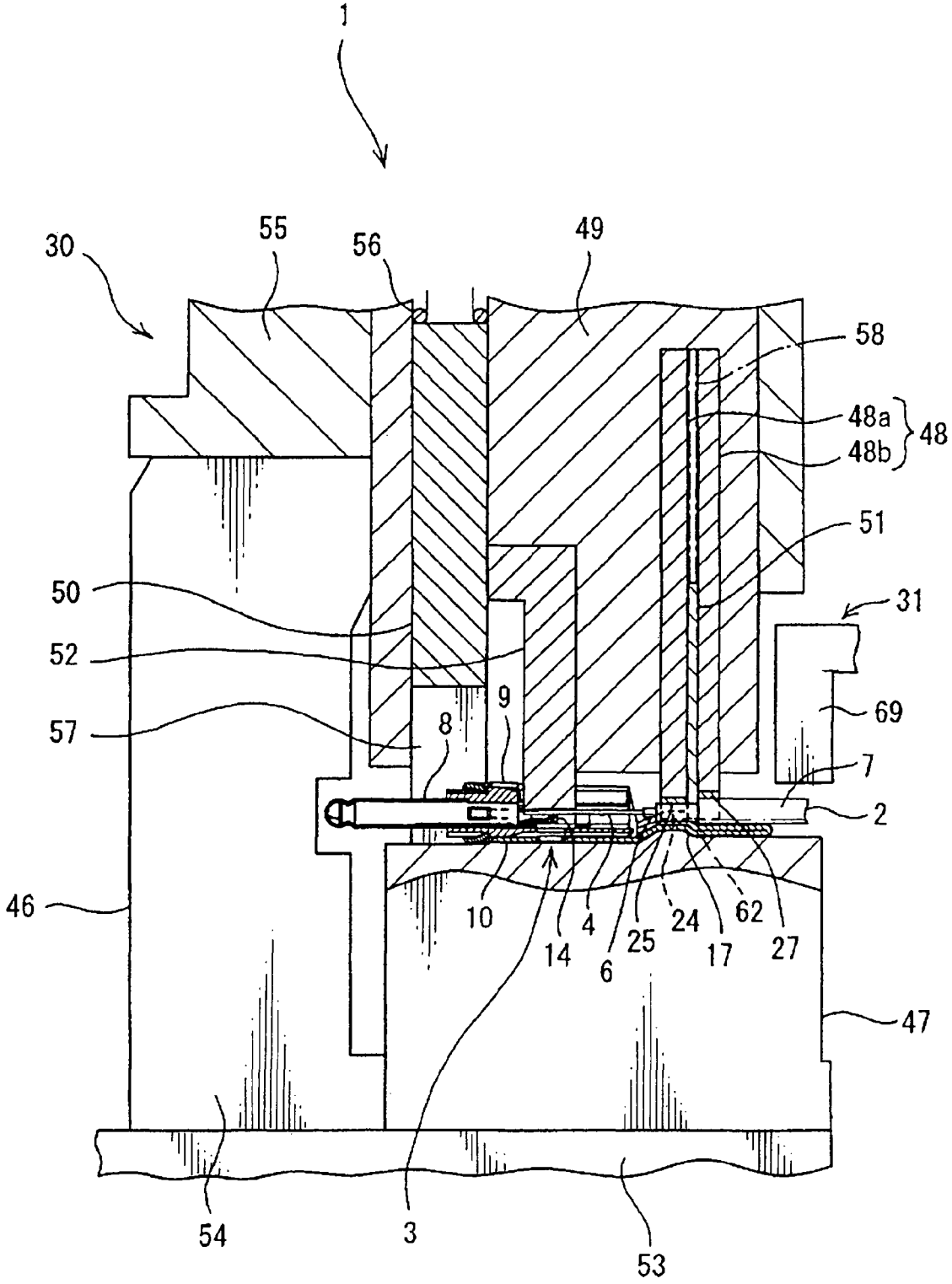
FIG. 6 is a partially cross-sectional side view illustrating a conductor core being pressure-contacted to a pressure-contacting portion by a pressure-contacting die and the crimping piece being crimped a crimper of the applicator shown in FIG. 5.
Figure 10:
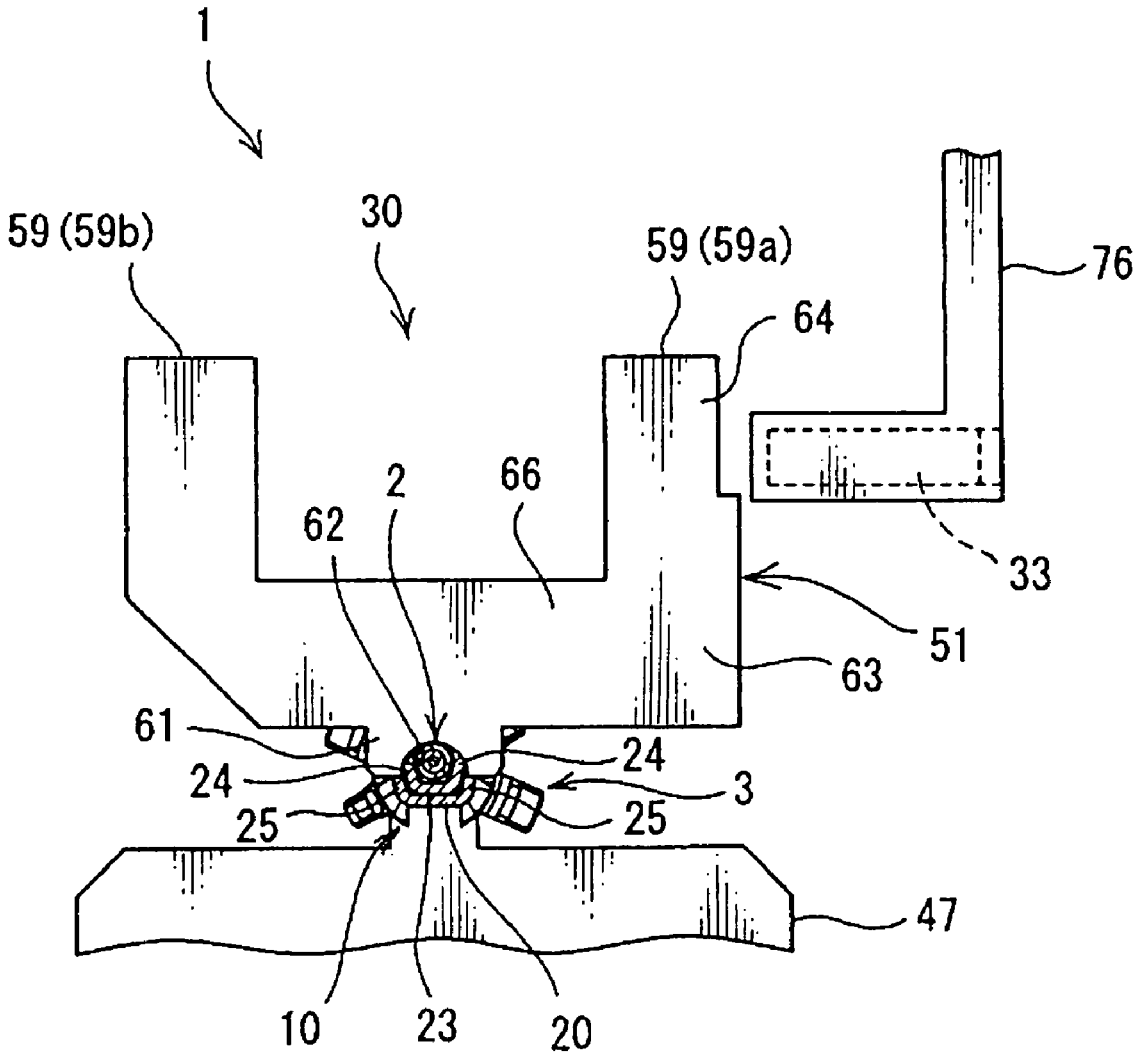
FIG. 10 is an explanative figure showing the relative position of the wire-inserting mold and the anvil, while in a state shown in FIG. 5.

When the first sensor 32 detects that the positioning mold 50 has positioned the plug 3 onto the anvil 47, the wire inserting mold 51 abuts on the braided conductor 6 of the shielded wire 2, and the wire inserting mold 51 positions the braided conductor 6 of the shielded wire 2, which is held by the chuck 69, into the wire positioning dent 62, as shown in FIG. 4. Then the CPU of the control device 34 further drives the servomotor 38 and the wire inserting mold 51 presses the braided conductor 6 of the shielded wire 2 towards the bottom plate 23, whereby the braided conductor 6 of the shielded wire 2 is inserted in between the pair of inner crimping pieces 24 of the crimping portion 21, as shown in FIG. 5 and 10.

The second sensor 33 will not detect the existence of the wide portion 63 of one of the parallel portions 59*a* of the wire-inserting mold 51 and detects the braided conductor 6 of the shielded wire 2 which is inserted in between the pair of inner crimping pieces 24. The CPU of the control device 34 then further drives the servomotor 38 to move the anvil 47 and the crimper 48 close with each other.

Figure 11:
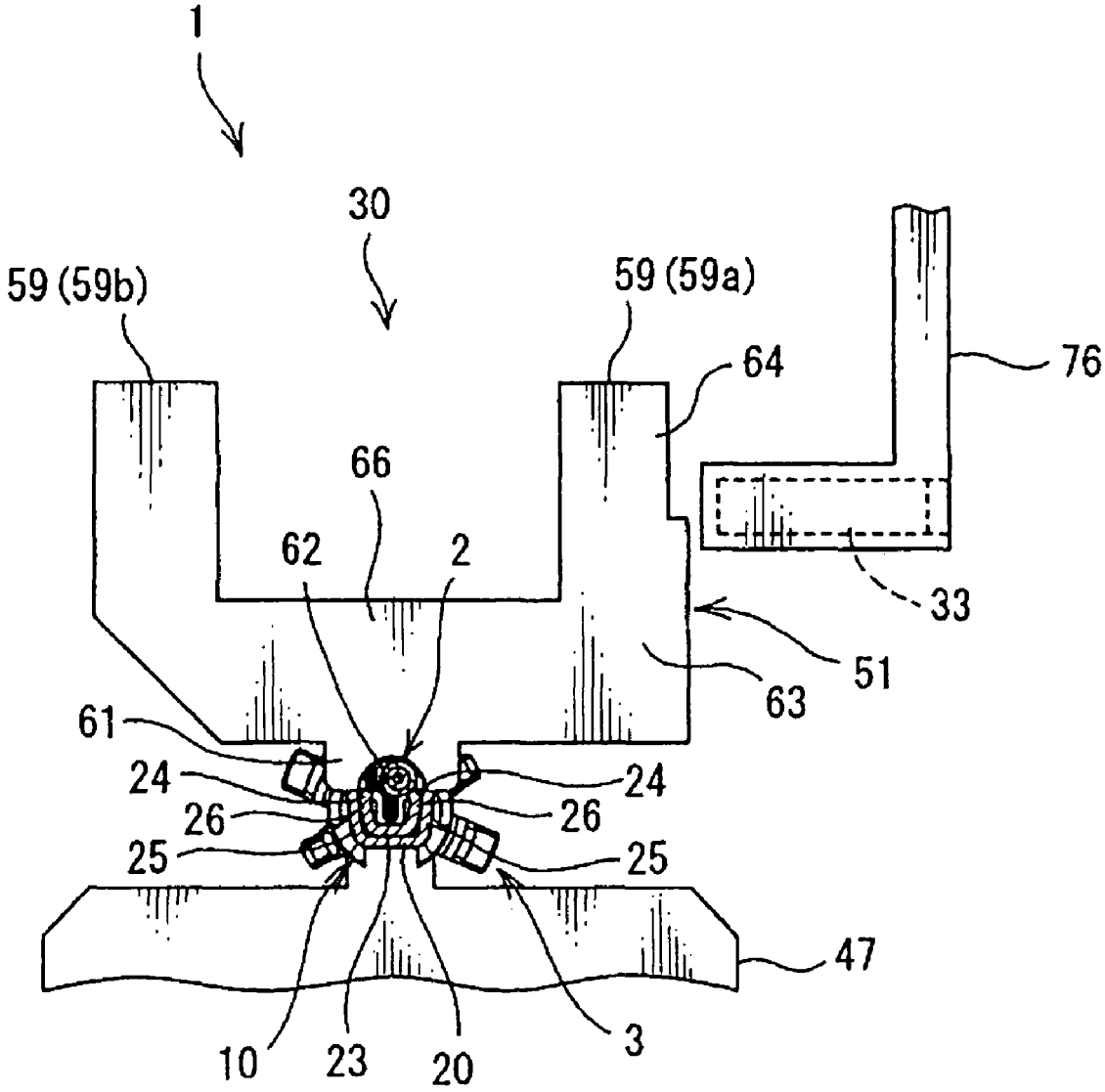
FIG. 11 is an explanative figure illustrating the wire-inserting mold failing to insert in between the pair of inner crimping piece of the applicator shown in FIG. 3.

When the braided conductor 6 of the shielded wire 2 is not positioned in the wire positioning dent 62 as shown in FIG. 11, the braided conductor 6 runs onto one of the pair of crimping pieces 24, and the braided conductor 6 of the shielded wire 2 will be put in between one of the pair of inner crimping pieces 24, and the wire pressing mold 51 presses the braided conductor 6 more towards the RAM 49 than when the braided conductor 6 is correctly inserted between the pair of inner crimping pieces 24 and sinks the braided conductor 6 into the RAM 49. The second sensor 33 detects the existence of the wide portion 63 of one of the parallel portion 59*a* of the wire inserting mold 51, and infers that the wire pressing mold 51 has not pressed the braided conductor 6 of the shielded wire 2 correctly between the pair of inner crimping piece 24, and the CPU of the control device 34 stops the movement of the servomotor 38. The CPU of the control device 34 commands the output device to send a signal of an error, indicating the wire-inserting mold 51 has failed to insert the braided conductor 6 of the shielded wire 2 correctly in between the pair of inner crimping pieces 24.

When the wire inserting mold 51 inserts the braided conductor 6 of the shielded wire 2 between the pair of inner crimping pieces 24, the pressure-contact mold 52 presses the conductor core 4 of the shielded wire 2 towards the crimping portion 12. When the second sensor 33 detects the wire inserting mold 51 inserting the braided conductor 6 of the shielded wire 2 between the pair of inner crimping pieces 24 (shown in FIG. 6), the CPU of the control device 34 further drives the servomotor 38, and the crimper 48*a*, 48*b* crimps the crimping pieces 24,25,27 and the pressure-contact mold 52 presses the conductor core 4 in between the slit 15 of the crimping blade 14 of the crimping portion 12.

The aforementioned terminal crimping apparatus 1, crimps the plug 3 to an end of the shielded wire 2 as explained. When the crimping work of the plug 3 to an end of the shielded wire 2 is completed, the CPU of the control device 34 of the terminal crimping apparatus 1 separates the anvil 47 and the crimper 48 apart, by controlling the servomotor 38. After separating the anvil 47 and the crimper 48 apart, the wire carrying device 31 carries an end of a next shielded wire to the applicator 30, and the next plug 3 is positioned onto the anvil 47 and crimps the next plug 3 to an end of the next shielded wire 2.

The aforementioned positioning mold 50 does not obstruct the crimper 48*a*, 48*b* crimping the crimping pieces 24, 25, 27 by sliding in the direction of sinking inside of the RAM 49, while the plug 3 is positioned on the anvil 47, and while the crimper 48*a*, 48*b* crimps the crimping pieces 24, 25, 27. Further, the mentioned wire inserting mold 51 does not obstruct the crimping work of the crimpers 48*a*, 48*b* by sliding in the direction of sinking inside of the RAM 49 while the braided conductor 6 of the shielded wire 2 is inserted between the pair of crimping pieces 24 and the crimpers 48*a*, 48*b* crimps the crimping pieces 24, 25, 27.

In the embodiment, the shielded wire 2 is securely inserted in between the curved crimping pieces 24 by the crimper 48 pressing the shielded wire 2 towards the bottom plate 23 before crimping the crimping pieces 24, 25, 27, and by having the wire pressing mold 51, which inserts the shielded wire 2 in between the pair of crimping pieces 24. Therefore, the shielded wire 2 can be crimped to the plug 3 securely. The embodiment is capable of crimping and pressure-contacting simultaneously by the crimper 48 pressing the shielded wire 2 towards the bottom plate 23 before the crimper 48 crimps the crimping pieces 24, 25, 27.

Still further, the shielded wire 2 and the plug 3 are prevented from moving out of their relative position in the lengthwise direction of the shielded wire 2, by the wire inserting mold 51 inserting the shielded wire 2 towards the bottom plate 23. Therefore, it is possible to securely crimp the shielded wire 2 to the plug 3 while maintaining a desired position in relation with each other.

Accordingly, the present invention enables to produce a plug 3 having a shielded wire 2 with the quality desired.

Since the wire inserting mold 51 is arranged slideably to the crimper 48, both the wire inserting mold 51 and the crimper 48 can be moved in the direction of approaching to and parting from the anvil 47 with only one servomotor 38, and reduces the number of components used in the terminal crimping apparatus 1. Therefore, the production cost of the terminal crimping apparatus 1 is reduced.

By the wire inserting mold 51 projecting more towards the anvil 47 than the crimper 48, the wire inserting mold 51 is enabled to insert the shielded wire 2 in between the pair of crimping pieces 24 before crimping the crimping pieces 24,25,27, and both the crimper 48, and the wire inserting mold 51 are being moved towards the direction of approaching and parting the anvil 47 by the servomotor 38. Therefore, it is possible to securely crimp the shielded wire 2 to the plug 3 with the curved crimping pieces 24.

Moreover, since the wire inserting mold 51 is slideably arranged to the crimper 48, and slides when the crimper 48 is urged by a spring 58 while crimping the crimping pieces 24, by the wire inserting mold 51 pressed by the anvil 47, repelling the urging force of the spring 58 and sliding against the crimper 48, obstruction by the wire-inserting mold 51 during the crimping work (the crimper 48 crimping the crimping piece 24) is prevented. Consequently, enables to securely attach the shielded wire 2 to the plug 3.

Since a servomotor 38 is used as the driving means for moving the crimper 48 and the wire inserting mold 51, the crimper 48 and the wire inserting mold 51 can be moved in sequences, in which, the crimper 48 inserts the shielded wire 2 in between the crimping pieces 24, and the crimper 48 crimping the crimping pieces 24. Accordingly, completion of each work phase can be monitored, enabling to reduce the defection rate in the finished product (the crimped shielded wire 2 equipped with a plug 3), preventing deterioration in the quality of the wire.

Since the wire inserting mold 51 has a positioning mold 50 which positions the plug 3 before the shielded wire 2 is inserted in between the inner crimping piece 24, the shielded wire 2 is securely inserted in between the pair of inner crimping pieces 24 of the plug 3. Therefore, the shielded wire 2 will be securely crimped to the plug 3.

Since the wire inserting mold 51 has a second sensor 33, which detects weather or not the shielded wire 2 is securely inserted in between the crimping pieces 24 and enabling to temporary stop the work before any crimping failure occurs and reduces the defection rate of crimping the shielded wire 2 to the plug 3.

Since the pressure-contact mold 52 is capable of pressure-contacting the conductor core 4 of the shielded wire 2 to the pressure-contact portion 12 of the plug 3, it is possible to crimp the conductor core 4 of the shielded wire 2 to the pressure-contact portion 12, while crimping the shielded wire 2 with the crimping pieces 24, 25, 27, at the same time, whereby the shielded wire 2 is crimped to a plug 3 of the shielded wire 2 in one sequence. Therefore, it is possible to attach the shielded wire 2 to the plug 3 of the shielded wire 2 in one step, reducing the number of work sequence.

By the aforementioned embodiment, a terminal crimping method explained from hereinunder can be acquired.

A terminal crimping method, where a plug 3 including a pair of crimping pieces 24 which stands vertically from a bottom plate 23, and each of the pair of crimping pieces 24 standing from the bottom plate 23 has a curved portion 26. The curved portion 26 is arranged at each end of the crimping pieces 24 further from the bottom plate 23 and bended in the direction of approaching each other.

After the plug 3 on the surface of the anvil 47 is fixed into position, the shielded wire 2 is inserted in between the pair of crimping piece 24, and the anvil 47 and the crimper 48 is then moved in the direction of approaching each other and crimps the shielded wire 2 in between the pair of crimping pieces 24, by bending the pair of crimping pieces 24 towards the direction of the bottom plate 23.

In the aforementioned embodiment, an end of a shielded wire 2 with a conductor core 4 is crimped to a plug 3 including a pressure-contacting portion 12. The present invention, however, is capable of crimping a braided conductor 6, or an end of a shielded wire without a conductor core with a conventional crimping terminal, which does not have the pressure-contacting portion.

The presented embodiment only represents a typical of an embodiment of the present invention, and does not limit the use of the present invention into the mentioned embodiment. In other words, the present invention can be adapted into various embodiments if not digressed from the scope of the invention.

What is claimed is:

1. A terminal crimping apparatus, for connecting an electric wire and a terminal, in which a pair of crimping pieces extending vertically from a bottom plate of the terminal is formed at each end farther from the bottom plate with a curved portion curved to approach each other to crimp the terminal by bending the crimp pieces so as to make the ends thereof close to the bottom plate, comprising:

a first die for placing the terminal on a surface thereof;

a second die, having crimpers, arranged correspondingly to the first die and freely approaching and parting the first die adapted to crimp the crimp pieces by approaching the first die; and a third die, comprising a wire inserting mold supported in a position projecting towards the first die, and placed between the crimpers, arranged parallel with the second die and correspondingly to the first die and freely approaching and parting from the first die to approach the first die before the second die crimps the crimping piece so as to push the electric wire toward the bottom plate and insert the electric wire between the pair of crimp pieces.

2. A terminal crimping apparatus according to claim 1, wherein the third die is arranged slidably in a direction of which the first die and the second die approach and part each other and is urged towards the first die by an urging means, further projecting towards the first die than the second die when the third die is separated from the first die.

3. A terminal crimping apparatus according to claim 2, further comprising a driving unit for moving the third and the second dies to approach and part together from the first die, wherein the driving unit is a servomotor.

4. A terminal crimping apparatus according to claim 1, wherein the first die and the second die are arranged slidably in the direction of approaching and parting each other, and a positioning jig is provided to urge towards the first die by an urging device to position the terminal by approaching towards the first die and clamping the terminal between the first die and itself before the third die inserts the electric wire in between the crimping pieces.

5. A terminal crimping apparatus according to claim 1, further comprising a detecting device for detecting whether or not the third die inserts the electric wire in between the pair of crimping pieces.

6. A terminal crimping apparatus according to claim 1, further comprising a pressure-contact mold for connecting the electric wire to a pressure-contact portion provided at the terminal by pressing the electric wire towards the pressure-contact portion.

7. A terminal crimping apparatus according to claim 2, wherein the first die and the second die are arranged slidably in the direction of approaching and parting each other, and a positioning jig is provided to urge towards the first die by an urging device to position the terminal by approaching towards the first die and clamping the terminal between the first die and itself before the third die inserts the electric wire in between the crimping pieces.

8. A terminal crimping apparatus according to claim 3, wherein the first die and the second die are arranged slidably in the direction of approaching and parting each other, and a positioning jig is provided to urge towards the first die by an urging device to position the terminal by approaching towards the first die and clamping the terminal between the first die and itself before the third die inserts the electric wire in between the crimping pieces.

9. A terminal crimping apparatus according to claim 2, further comprising a detecting device for detecting whether or not the third die inserts the electric wire in between the pair of crimping pieces.

10. A terminal crimping apparatus according to claim 3, further comprising a detecting device for detecting whether or not the third die inserts the electric wire in between the pair of crimping pieces.

11. A terminal crimping apparatus according to claim 4, further comprising a detecting device for detecting whether or not the third die inserts the electric wire in between the pair of crimping pieces.

12. A terminal crimping apparatus according to claim 2, further comprising a pressure-contact mold which connects the electric wire to a pressure-contact portion provided at the terminal by pressing the electric wire towards the pressure-contact portion.

13. A terminal crimping apparatus according to claim 3, further comprising a pressure-contact mold which connects the electric wire to a pressure-contact portion provided at the terminal by pressing the electric wire towards the pressure-contact portion.

14. A terminal crimping apparatus according to claim 4, further comprising a pressure-contact mold which connects the electric wire to a pressure-contact portion provided at the terminal by pressing the electric wire towards the pressure-contact portion.

15. A terminal crimping apparatus according to claim 5, further comprising a pressure-contact mold which connects the electric wire to a pressure-contact portion provided at the terminal by pressing the electric wire towards the pressure-contact portion.

* * * * *